US010510249B2

(12) United States Patent
Tokunaga et al.

(10) Patent No.: US 10,510,249 B2
(45) Date of Patent: Dec. 17, 2019

(54) SAFETY DRIVING ASSISTANT SYSTEM, VEHICLE, AND PROGRAM

(71) Applicants: SUMITOMO ELECTRIC INDUSTRIES, LTD., Osaka-shi, Osaka (JP); HONDA MOTOR CO., LTD., Tokyo (JP)

(72) Inventors: Masataka Tokunaga, Osaka (JP); Shoichi Tanada, Osaka (JP); Shigeki Nishimura, Osaka (JP); Hiroyuki Yamada, Osaka (JP); Hitoshi Konishi, Wako (JP)

(73) Assignees: SUMITOMO ELECTRIC INDUSTRIES, LTD., Osaka-shi, Osaka (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/096,044

(22) PCT Filed: Mar. 30, 2017

(86) PCT No.: PCT/JP2017/013381
§ 371 (c)(1),
(2) Date: Oct. 24, 2018

(87) PCT Pub. No.: WO2017/187883
PCT Pub. Date: Nov. 2, 2017

(65) Prior Publication Data

US 2019/0130742 A1 May 2, 2019

(30) Foreign Application Priority Data

Apr. 28, 2016 (JP) ..... 2016-090261

(51) Int. Cl.
*G08G 1/09* (2006.01)
*G08G 1/0967* (2006.01)
(Continued)

(52) U.S. Cl.
CPC ..... *G08G 1/096791* (2013.01); *G08G 1/01* (2013.01); *G08G 1/09* (2013.01); *G08G 1/165* (2013.01)

(58) Field of Classification Search
CPC ..... G08G 1/096791; G08G 1/165
See application file for complete search history.

(56) References Cited

U.S. PATENT DOCUMENTS

2014/0015663 A1* 1/2014 Uno ..... B60W 40/08 340/439
2016/0078757 A1* 3/2016 Inaba ..... G09B 29/10 701/119

FOREIGN PATENT DOCUMENTS

JP H10-300493 A 11/1998
JP 2002-163792 A 6/2002
(Continued)

*Primary Examiner* — Curtis B Odom
(74) *Attorney, Agent, or Firm* — Drinker Biddle & Reath LLP

(57) ABSTRACT

A safety driving assistant system according to one aspect of the present disclosure includes: an acquisition unit configured to acquire pieces of probe information from probe vehicles, each piece of probe information including information of a position of the corresponding probe vehicle and information of a time at which the probe vehicle has passed through the position; a detection unit configured to detect a sudden-deceleration-prone spot where sudden deceleration of probe vehicles frequently occurs, based on the pieces of probe information acquired by the acquisition unit; and a provision unit configured to provide information of the sudden-deceleration-prone spot detected by the detection unit, to a target vehicle that receives safety driving assistance.

9 Claims, 13 Drawing Sheets

(51) Int. Cl.
*G08G 1/01* (2006.01)
*G08G 1/16* (2006.01)

(56) References Cited

FOREIGN PATENT DOCUMENTS

| | | | |
|---|---|---|---|
| JP | 2015-069501 | A | 4/2015 |
| JP | 2015-121959 | A | 7/2015 |
| JP | 2015-161651 | A | 9/2015 |
| JP | 2015-161967 | A | 9/2015 |
| JP | 2015-161968 | A | 9/2015 |
| JP | 2015-194938 | A | 11/2015 |
| JP | 2016-057066 | A | 4/2016 |

* cited by examiner

SAFETY DRIVING ASSISTANT SYSTEM, VEHICLE, AND PROGRAM

TECHNICAL FIELD

The present disclosure relates to safety driving assistant systems, vehicles, and programs.

This application claims priority on Japanese Patent Application No. 2016-90261 filed on Apr. 28, 2016, the entire contents of which are incorporated herein by reference.

BACKGROUND ART

Japanese Laid-Open Patent Publication No. 2002-163792 (Patent Literature 1) discloses a system in which an image of a curved section of a road is captured with a camera installed on the road side to detect an obstacle, and the result of the obstacle detection is provided to a driver of a vehicle by using a road-to-vehicle communication device.

Meanwhile, Japanese Laid-Open Patent Publication No. 2015-121959 (Patent Literature 2) discloses an obstacle detection device configured to detect an obstacle by using an ultrasonic sensor mounted on a vehicle, and provides the result of the obstacle detection to a driver of the vehicle.

CITATION LIST

Patent Literature

PATENT LITERATURE 1: Japanese Laid-Open Patent Publication No. 2002-163792

PATENT LITERATURE 2: Japanese Laid-Open Patent Publication No. 2015-121959

PATENT LITERATURE 3: Japanese Laid-Open Patent Publication No. H10-300493

PATENT LITERATURE 4: Japanese Laid-Open Patent Publication No. 2015-161967

PATENT LITERATURE 5: Japanese Laid-Open Patent Publication No. 2015-161968

SUMMARY OF INVENTION

A safety driving assistant system according to one aspect of the present disclosure includes: an acquisition unit configured to acquire pieces of probe information from probe vehicles, each piece of probe information including information of a position of the corresponding probe vehicle and information of a time at which the probe vehicle has passed through the position; a detection unit configured to detect a sudden-deceleration-prone spot where sudden deceleration of probe vehicles frequently occurs, based on the pieces of probe information acquired by the acquisition unit; and a provision unit configured to provide information of the sudden-deceleration-prone spot detected by the detection unit, to a target vehicle that receives safety driving assistance.

A vehicle according to another aspect of the present disclosure includes: an acquisition unit configured to acquire, from a server, information of a sudden-deceleration-prone spot where sudden deceleration of probe vehicles frequently occurs, the sudden-deceleration-prone spot being detected based on pieces of probe information each including information of a position of the corresponding probe vehicle and information of a time at which the probe vehicle has passed through the position; and a safety driving assistant unit configured to execute a safety driving assistant process for the vehicle, based on the information of the sudden-deceleration-prone spot acquired by the acquisition unit.

Not limited to the safety driving assistant system or the vehicle including the aforementioned characteristic processing units, still another aspect of the present disclosure can be implemented as a method including process steps to be executed by the characteristic processing units included in the safety driving assistant system or the vehicle. In addition, yet another aspect of the present disclosure can be implemented as a program for causing a computer to function as the characteristic processing units included in the safety driving assistant system or the vehicle, or as a program for causing a computer to execute the characteristic process steps included in the method. It is needless to say that such a program can be distributed through a computer-readable non-transitory recording medium such as a CD-ROM (Compact Disc-Read Only Memory), or a communication network such as the Internet. A further aspect of the present disclosure can be implemented as a semiconductor integrated circuit that realizes a part or the entirety of the safety driving assistant system or the vehicle.

DESCRIPTION OF EMBODIMENTS

Figure 1:
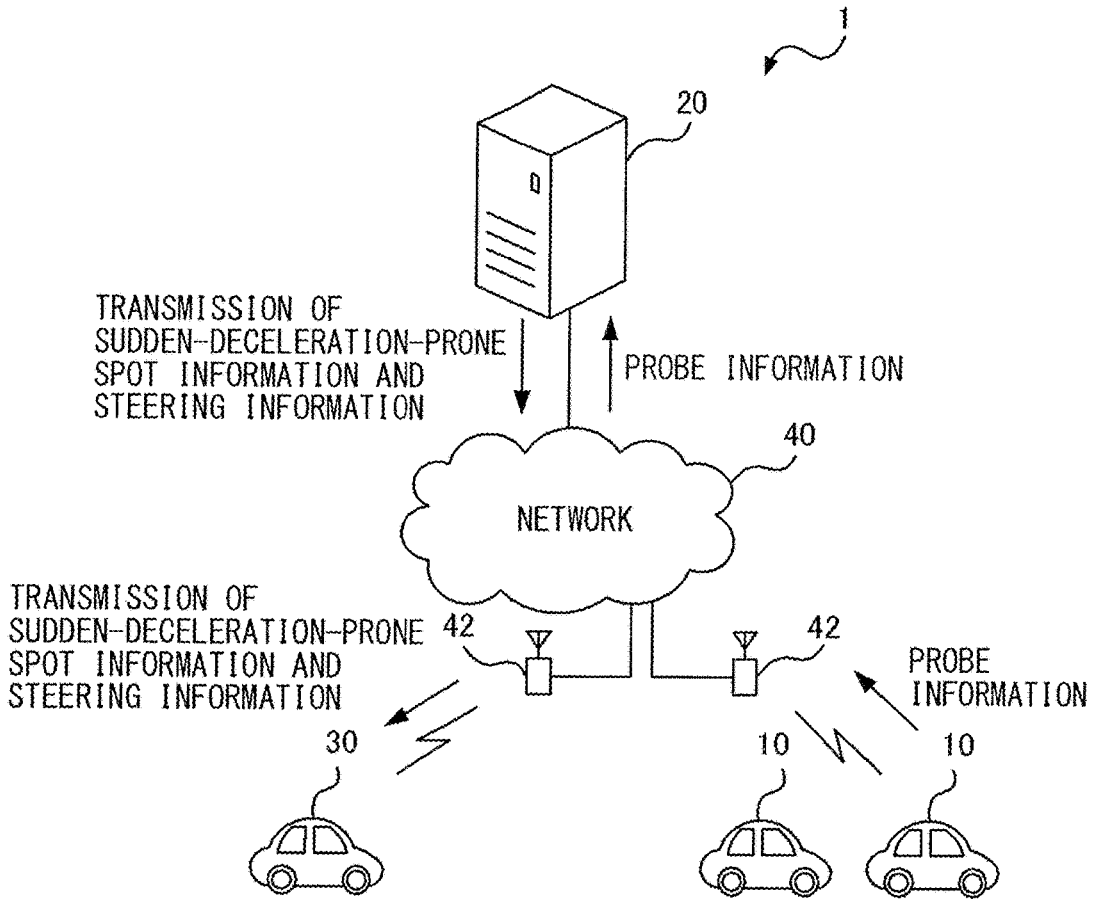
FIG. 1 is a diagram showing a configuration of a safety driving assistant system according to a first embodiment of the present disclosure.

When an obstacle such as an object dropped from a vehicle or a tree broken by strong wind, or an obstacle such as a vehicle stopped due to an accident, failure, or the like, is present on a road, the obstacle hinders progress of a vehicle traveling on the road. In particular, when an obstacle is present on a freeway or on a road at a position being a blind spot for drivers, such as a position ahead of a corner of the road, a vehicle is suddenly decelerated or a driver makes a sudden steering operation to avoid the obstacle, which makes traveling safely difficult. Therefore, systems and the like for assisting safe driving by detecting obstacles in advance have been developed to date.

Technical Problem

According to the system disclosed in Patent Literature 1, obstacles can be detected in an area where the camera is installed, whereas obstacles cannot be detected in other areas. Therefore, in order to detect obstacles in many areas, installation cost of cameras is increased.

Meanwhile, according to the obstacle detector disclosed in Patent Literature 2, the obstacle detection device cannot detect an obstacle unless the obstacle detection device is approaching the obstacle, and therefore cannot detect, in advance, an obstacle present at a blind spot such as a position ahead of a corner, or an obstacle present in a far place.

Therefore, in one aspect of the present disclosure, it is an object of the present disclosure to provide a safety driving assistant system and a program which are able to provide, in advance, a target vehicle with information of a spot where sudden deceleration frequently occurs among arbitrary spots on a road, in order to provide the target vehicle with information of an obstacle that is present in an arbitrary spot on the road.

It is another object of the present disclosure to provide a vehicle and a program which acquire, in advance, information of a spot where sudden deceleration frequently occurs among arbitrary spots on a road, and assist safe driving of the vehicle.

Advantageous Effects of Disclosure

According to the present disclosure, in order to provide a target vehicle with information of an obstacle present at an arbitrary spot on a road, it is possible to provide, in advance, the target vehicle with information of a spot where sudden deceleration frequently occurs among arbitrary spots on the road. Further, it is possible for a vehicle to acquire, in advance, information of a spot where sudden deceleration frequently occurs among arbitrary spots on a road, and assist safe driving of the vehicle.

DESCRIPTION OF EMBODIMENTS

First, contents of embodiments of the present disclosure will be listed and described.

A safety driving assistant system according to one aspect of the present disclosure includes: an acquisition unit configured to acquire pieces of probe information from probe vehicles, each piece of probe information including information of a position of the corresponding probe vehicle and information of a time at which the probe vehicle has passed through the position; a detection unit configured to detect a sudden-deceleration-prone spot where sudden deceleration of the probe vehicles frequently occurs, based on the pieces of probe information acquired by the acquisition unit; and a provision unit configured to provide information of the sudden-deceleration-prone spot detected by the detection unit, to a target vehicle that receives safety driving assistance.

According to this configuration, the sudden-deceleration-prone spot is detected based on the pieces of probe information acquired from the probe vehicles, and information of the sudden-deceleration-prone spot is provided to the target vehicle. Since each probe vehicle can travel in an arbitrary position on a road, probe information thereof at an arbitrary position can be acquired. Therefore, a sudden-deceleration-prone spot at an arbitrary position on the road can be detected. Further, there is no limitation on the place where the information of the sudden-deceleration-prone spot is provided. Accordingly, it is possible to provide, in advance, the target vehicle with information of a spot where sudden deceleration frequently occurs among arbitrary spots on the road.

Preferably, each piece of probe information further includes information of a lane on which the corresponding probe vehicle travels, and the detection unit detects the sudden-deceleration-prone spot for each lane, based on the pieces of probe information.

According to this configuration, the spot where sudden deceleration occurs can be accurately detected. In other words, it is possible to detect on which lane sudden deceleration frequently occurs. A target vehicle coming from the upstream side of the spot and the lane where sudden deceleration frequently occurs can take an action such as a lane change from the lane to avoid an obstacle.

Preferably, the detection unit detects the sudden-deceleration-prone spot, based on probe information acquired from a lane identifiable vehicle capable of identifying a traveling lane thereof, among the pieces of probe information acquired by the acquisition unit.

A lane identifiable vehicle, represented by an automatic traveling vehicle, travels while identifying the traveling lane thereof, based on map information having highly-accurate positional information. Therefore, information of the lane can be included in the probe information acquired from the lane identifiable vehicle. Thus, a spot where sudden deceleration frequently occurs can be detected for each lane. In addition, the lane identifiable vehicle includes various sensors such as a camera and a radar for observing the surrounding situations, and is designed to perform safe driving at all times, and therefore does not perform unnecessary sudden deceleration. Therefore, when even such a lane identifiable vehicle has to perform sudden deceleration, it is considered that an obstacle is highly likely to be present. Therefore, by detecting a sudden-deceleration-prone spot based on the probe information acquired from the lane identifiable vehicle, reliability of the sudden-deceleration-prone spot can be increased, resulting in safer driving support for the target vehicle.

Preferably, the detection unit detects, for a target link, sudden-deceleration-prone spots, based on pieces of first probe information that are the pieces of probe information acquired by the acquisition unit and on second probe information that is the probe information acquired from the lane identifiable vehicle among the pieces of first probe information. The detection unit adopts, as the sudden-deceleration-prone spot on the target link, the sudden-deceleration-prone spot detected based on the second probe information in preference to the sudden-deceleration-prone spot detected based on the first probe information.

According to this configuration, the sudden-deceleration-prone spot detected based on the second probe information can be adopted as the detection result in preference to the sudden-deceleration-prone spot detected based on the first probe information. As described above, the sudden-deceleration-prone spot detected based on the second probe information acquired from the lane identifiable vehicle is highly reliable. Therefore, the highly reliable sudden-deceleration-prone spot can be preferentially detected.

Preferably, the detection unit totalizes, for a target link, the number of occurrences of sudden deceleration of the lane identifiable vehicle, which is based on the probe information acquired from the lane identifiable vehicle among the pieces of probe information acquired by the acquisition unit, after weighting the number of occurrences more than the number of occurrences of sudden deceleration, of the lane identifiable vehicle, which is based on pieces of probe information acquired from vehicles other than the lane identifiable vehicle among the pieces of probe information acquired by the acquisition unit. The detection unit detects the sudden-deceleration-prone spot on the target link, based on the result of the totalization.

According to this configuration, the sudden-deceleration-prone spot is detected while placing greater weight on the probe information acquired from the lane identifiable vehicle than on the pieces of probe information acquired from vehicles other than the lane identifiable vehicle. As described above, the sudden-deceleration-prone spot detected based on the probe information acquired from the lane identifiable vehicle is highly reliable. On the other hand, when a sudden-deceleration-prone spot is detected based on the pieces of probe information acquired from the vehicles other than the lane identifiable vehicle, a wider area can be covered. Therefore, it is possible to detect sudden-deceleration-prone spots in a wide area while detecting highly-reliable sudden-deceleration-prone spots.

Preferably, the acquisition unit further acquires information relating to steering of each probe vehicle. The safety driving assistant system further includes a creation unit configured to create information relating to a steering direction of the probe vehicle at the sudden-deceleration-prone spot detected by the detection unit, based on the corresponding probe information acquired by the acquisition unit. The provision unit further provides, to the target vehicle, information relating to the steering direction of the probe vehicle created by the creation unit.

According to this configuration, the information of the steering direction accompanying a steering operation performed by the probe vehicle at the sudden-deceleration-prone spot can be provided to the target vehicle. Therefore, based on the information, the target vehicle can perform a steering operation to avoid an obstacle.

Preferably, the detection unit detects the sudden-deceleration-prone spot, based on positions on a link relating to positions of the probe vehicles indicated by the pieces of probe information acquired by the acquisition unit.

According to this configuration, even when the positions indicated by the pieces of probe information are deviated from the link of the road, the sudden-deceleration-prone spot can be detected with the positions being matched with the positions on the link. Therefore, the sudden-deceleration-prone spot on the road can be accurately detected.

A vehicle according to another aspect of the present disclosure includes: an acquisition unit configured to acquire, from a server, information of a sudden-deceleration-prone spot where sudden deceleration of probe vehicles frequently occurs, the sudden-deceleration-prone spot being detected based on pieces of probe information each including information of a position of the corresponding probe vehicle and information of a time at which the probe vehicle has passed through the position; and a safety driving assistant unit configured to execute a safety driving assistant process for the vehicle, based on the information of the sudden-deceleration-prone spot acquired by the acquisition unit.

According to this configuration, the sudden-deceleration-prone spot, which has been detected based on the pieces of probe information acquired from the probe vehicles, is acquired. Since each probe vehicle can travel through an arbitrary position on a road, probe information thereof at the arbitrary position can be acquired. Therefore, a sudden-deceleration-prone spot at the arbitrary position on the road can be detected. Further, there is no limitation on a place there the information of the sudden-deceleration-prone spot is acquired. Accordingly, the vehicle can acquire, in advance, information of a spot where sudden deceleration frequently occurs among arbitrary spots on the road, and support safe driving of the vehicle.

A program according to still another aspect of the present disclosure causes a computer to function as: an acquisition unit configured to acquire pieces of probe information from probe vehicles, each piece of probe information including information of a position of the corresponding probe vehicle and information of a time at which the probe vehicle has passed through the position; a detection unit configured to detect a sudden-deceleration-prone spot where sudden deceleration of probe vehicles frequently occurs, based on the pieces of probe information acquired by the acquisition unit; and a provision unit configured to provide information of the sudden-deceleration-prone spot detected by the detection unit, to a target vehicle that receives safety driving assistance.

This configuration is the same as the configuration of the aforementioned safety driving assistant system. Therefore, the same operation and effect as described above are achieved.

A program according to yet another aspect of the present disclosure causes a computer to function as: an acquisition unit configured to acquire, from a server, information of a sudden-deceleration-prone spot where sudden deceleration of probe vehicles frequently occurs, the sudden-deceleration-prone spot being detected based on pieces of probe information each including information of a position of the corresponding probe vehicle and information of a time at which the probe vehicle has passed through the position; and a safety driving assistant unit configured to execute a safety driving assistant process for the vehicle, based on the information of the sudden-deceleration-prone spot acquired by the acquisition unit.

This configuration is the same as the configuration of the aforementioned vehicle. Therefore, the same operation and effect as described above are achieved.

Detailed Description of Embodiments

Hereinafter, embodiments of the present disclosure will be described in detail with reference to the drawings. It is to be noted that each of the embodiments described below shows a preferable and specific example of the present disclosure. Numerical values, shapes, components, arrangement and connection configuration of the components, steps, processing order of the steps, etc., shown in the following embodiments are merely examples, and are not intended to limit the scope of the present disclosure. The present disclosure is specified in claims. Therefore, among the components in the following embodiments, components not recited in any one of independent claims defining the most generic concept of the present disclosure are not necessarily required to achieve the objects of the present disclosure, but are used to form preferable embodiments.

At least some parts of the embodiments described below may be combined together as appropriate.

First Embodiment

[1-1. Overall Configuration of System]

FIG. 1 is a diagram showing a configuration of a safety driving assistant system according to a first embodiment of the present disclosure.

With reference to FIG. 1, a safety driving assistant system 1 is a system for assisting safe driving of a target vehicle traveling on a road, and includes a plurality of probe vehicles 10, a server 20, and a target vehicle 30.

Each probe vehicle 10 generates, at predetermined time intervals (e.g., 3-second intervals), probe information including at least information of the position where the probe vehicle 10 travels and information of the time at which the probe vehicle 10 has passed through the position. The probe vehicle 10 transmits the generated probe information to the server 20 via a wireless base station 42 and a network 40. Transmission of the probe information to the server 20 may be performed in real time, or may be performed at predetermined time intervals or at a time when a predetermined number of pieces of probe information have been accumulated. The network 40 may be a public communication network such as the Internet or a mobile phone network, or may be a private communication network.

The server 20 is installed in a traffic control center or the like. The server 20 receives the probe information from each probe vehicle 10. Based on the received probe information, the server 20 detects a spot, on a road, where sudden deceleration of probe vehicles 10 frequently occurs (hereinafter referred to as "sudden-deceleration-prone spot"). The server 20 provides information of the detected sudden-deceleration-prone spot to the target vehicle 30 which receives safety driving assistance or to a driver of the target vehicle 30 through the network 40 and the wireless base station 42.

The target vehicle 30 is an ordinary vehicle driven by a driver (hereinafter referred to as "general traveling vehicle") or an automatic traveling vehicle. The target vehicle 30 receives the information of the sudden-deceleration-prone spot, which is provided from the server 20, and executes a safety driving assistant process for the target vehicle 30, based on the received information. That is, the target vehicle 30 displays the information of the sudden-deceleration-prone spot on a screen of a navigation device. When the target vehicle 30 is an automatic traveling vehicle, the target vehicle 30 performs, according to need, driving control such as a lane change or deceleration in order to avoid the sudden-deceleration-prone spot.

[1-2. Configuration of Probe Vehicle 10]

Figure 2:
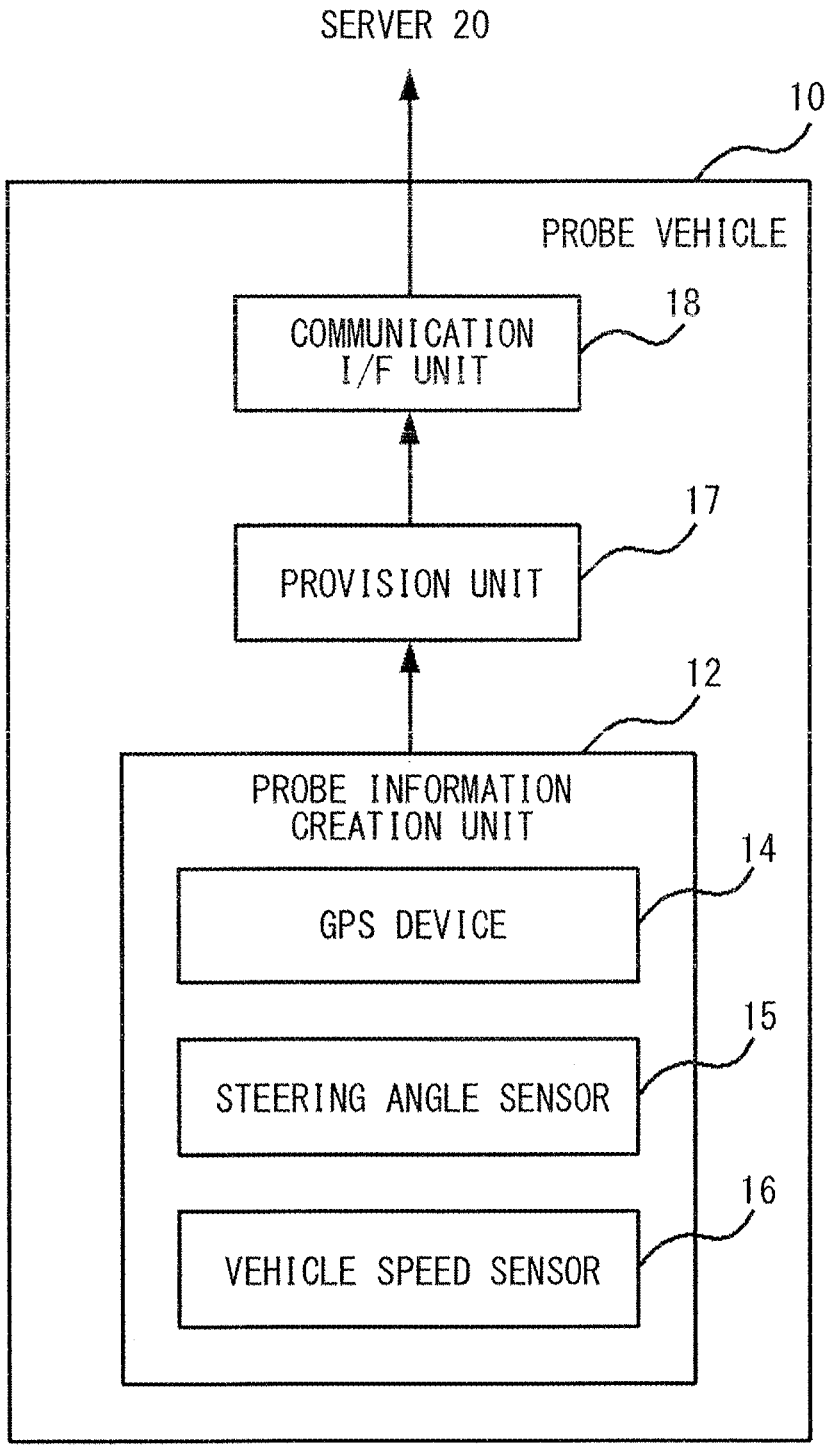
FIG. 2 is a block diagram showing a functional configuration of a probe vehicle.

FIG. 2 is a block diagram showing a functional configuration of a probe vehicle 10. FIG. 2 shows only processing units relating to generation of probe information, while illustration of processing units relating to traveling of the probe vehicle 10 is omitted.

With reference to FIG. 2, the probe vehicle 10 includes a probe information generation unit 12, a provision unit 17, and a communication I/F (interface) unit 18. The probe information generation unit 12 and the provision unit 17 are implemented by a processor that performs digital signal processing, such as a CPU (Central Processing Unit) or an MPU (Micro-Processing Unit). These units 12 and 17 may be implemented by a single processor, or may be implemented by separate processors.

The probe information generation unit 12 is configured to include a GPS (Global Positioning System) device 14, a steering angle sensor 15, and a vehicle speed sensor 16. The probe information generation unit 12 generates, at predetermined time intervals, probe information including at least information of the position of the probe vehicle 10 measured by the GPS device 14 and information of the time at which the probe vehicle 10 has passed through the position. The positional information of the probe vehicle 10 includes latitude information and longitude information. In addition, the probe information generation unit 12 includes, in the probe information, information of the steering direction, i.e., the steering angle, of the probe vehicle 10, which is detected by the steering angle sensor 15. Further, the probe information generation unit 12 includes, in the probe information, information of the traveling speed of the probe vehicle 10, which is detected by the vehicle speed sensor 16. The vehicle speed sensor 16 obtains the speed information by measuring the number of rotations of the wheels of the probe vehicle 10.

The provision unit 17 transmits the probe information generated by the probe information generation unit 12 through the communication I/F unit 18, thereby providing the probe information to the server 20. As described above, the probe information may be transmitted one by one in real time, or a plurality of pieces of probe information may be transmitted in a batch.

The communication I/F unit 18 is a communication interface for wirelessly transmitting data, and is implemented by a wireless module or the like.

The probe information generation unit 12, the provision unit 17, and the communication I/F unit 18 shown in FIG. 2 may be implemented by a dedicated probe terminal, or may be implemented by a general terminal such as a smart phone used by the driver of the probe vehicle 10.

[1-3. Configuration of Server 20]

Figure 3:
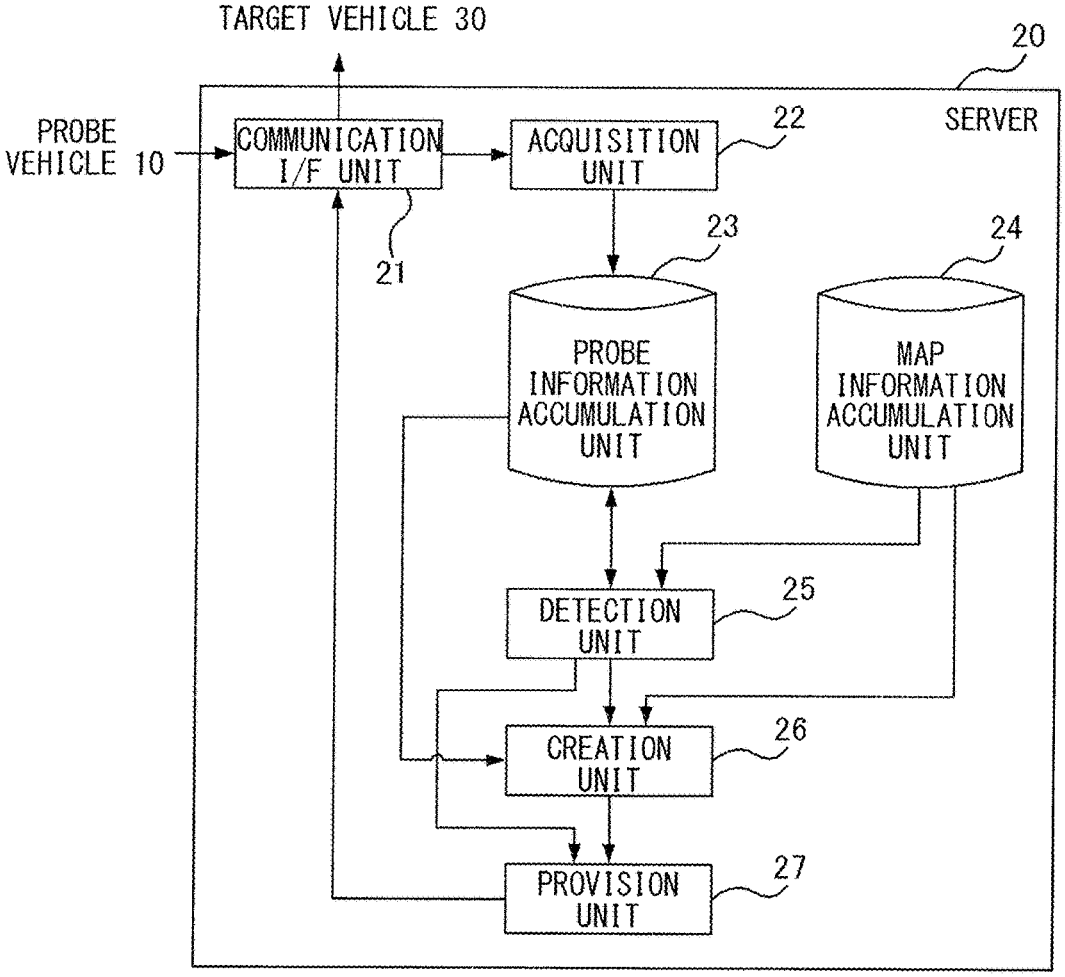
FIG. 3 is a block diagram showing a functional configuration of a server.

FIG. 3 is a block diagram showing a functional configuration of the server 20. The server 20 is implemented by a computer including: a processor that performs digital signal processing, such as a CPU or an MPU; an RAM (Random Access Memory); an ROM (Read Only Memory), and the like. When a predetermined program is executed on the CPU, processing units in the server 20 are operated.

With reference to FIG. 3, the server 20 includes a communication I/F unit 21, an acquisition unit 22, a probe information accumulation unit 23, a map information accumulation unit 24, a detection unit 25, a creation unit 26, and a provision unit 27. The acquisition unit 22, the detection unit 25, the creation unit 26, and the provision unit 27 are implemented by a processor such as a CPU. These units 22, 25, 26, and 27 may be implemented by a single processor, or may be implemented by separate processors.

The communication I/F unit 21 is a communication interface for wirelessly exchanging data with each probe vehicle 10 and the target vehicle 30. The communication I/F unit 21 is implemented by a wireless module or the like.

The acquisition unit 22 acquires the probe information from each probe vehicle 10 via the communication I/F unit 21.

The probe information accumulation unit 23 is a storage unit in which the probe information acquired by the acquisition unit 22 is accumulated, and is implemented by an HDD (Hard Disc Drive) or the like.

The map information accumulation unit 24 is a storage unit in which map information of roads on which vehicles travel is accumulated, and is implemented by an HDD or the like.

The detection unit 25 detects a spot where sudden deceleration of probe vehicles 10 frequently occurs, based on the probe information acquired by the acquisition unit 22 and accumulated in the probe information accumulation unit 23. The method of detecting the sudden-deceleration-prone spot will be described later.

The creation unit 26 creates information relating to the steering direction of each probe vehicle 10 (hereinafter referred to as "steering information") at the sudden-deceleration-prone spot detected by the detection unit 25, based on the probe information acquired by the acquisition unit 22 and accumulated in the probe information accumulation unit 23. That is, the creation unit 26 creates information indicating what steering operation the probe vehicle 10 or the driver of the probe vehicle 10 has performed to avoid an obstacle. The method of creating the steering information will be described later in detail.

The provision unit 27 transmits the information of the sudden-deceleration-prone spot (hereinafter referred to as "sudden-deceleration-prone spot information") detected by the detection unit 25 and the steering information created by the creation unit 26, to the target vehicle 30 through the communication I/F unit 21. Thus, the provision unit 27 provides these pieces of information to the target vehicle 30 or the driver of the target vehicle 30.

[1-4. Configuration of Target Vehicle 30]

Figure 4:
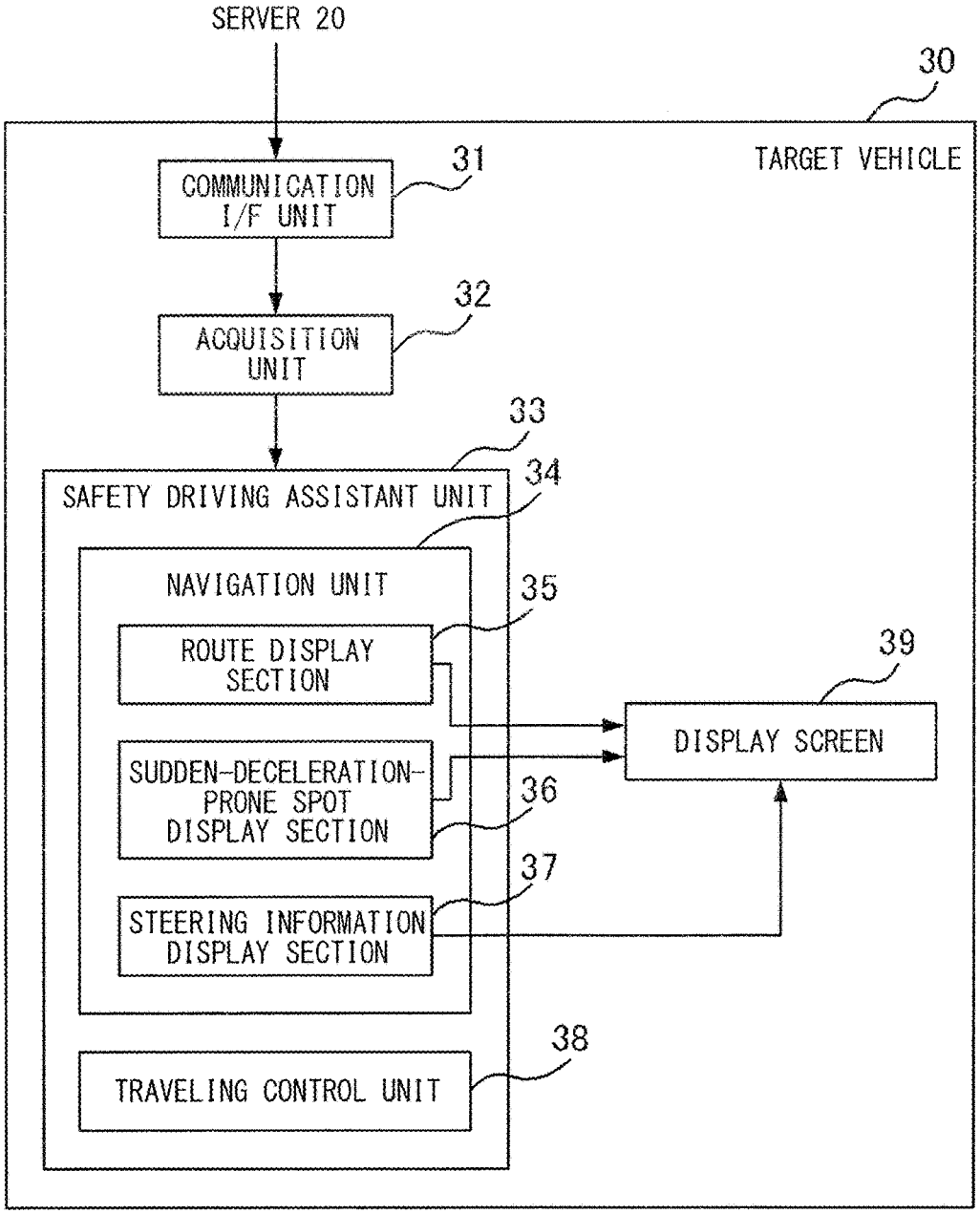
FIG. 4 is a block diagram showing a functional configuration of a target vehicle.

FIG. 4 is a block diagram showing a functional configuration of the target vehicle 30.

With reference to FIG. 4, the target vehicle 30 includes a communication I/F unit 31, an acquisition unit 32, a safety driving assistant unit 33, and a display screen 39. The acquisition unit 32 and the safety driving assistant unit 33 are implemented by, for example, a processor that performs digital signal processing, such as a CPU or an MPU. These units 32 and 33 may be implemented by a single processor, or may be implemented by separate processors.

The communication I/F unit 31 is a communication interface for wirelessly receiving data from the server 20, and is implemented by a wireless module or the like.

The acquisition unit 32 acquires the sudden-deceleration-prone spot information and the steering information from the server 20 via the communication I/F unit 31.

The safety driving assistant unit 33 is a processing unit that executes a process of assisting safe driving of the target vehicle 30, based on the sudden-deceleration-prone spot information and the steering information acquired by the acquisition unit 32. The safety driving assistant unit 33 includes a navigation unit 34 and a traveling control unit 38. The navigation unit 34 and the traveling control unit 38 are also implemented by a processor such as a CPU or an MPU. These units 34 and 38 may be implemented by a single processor, or may be implemented by separate processors.

The display screen 39 is a display unit such as a display used for the safety driving assistant process by the safety driving assistant unit 33.

The navigation unit 34 is a processing unit that performs route guidance to a destination, for the driver of the target vehicle 30. The navigation unit 34 includes a route display section 35, a sudden-deceleration-prone spot display section 36, and a steering information display section 37. The route display section 35 calculates a route to a destination, and performs control to display the calculated route on the display screen 39. The sudden-deceleration-prone spot display section 36 performs control to display, in a visible manner, the sudden-deceleration-prone spot in the route to the destination displayed on the display screen 39. The sudden-deceleration-prone spot display section 36 displays, for example, a road section of a predetermined distance including the sudden-deceleration-prone spot (e.g., a road section having a distance of 5 m in each of forward and backward directions from the sudden-deceleration-prone spot) in a color different from a color of other road sections. The steering information display section 37 performs control to display the steering information on the display screen 39. For example, the steering information display section 37 performs control to display the steering information at a lower right corner of the display screen 39. Thus, the driver of the target vehicle 30 can know what steering operations the probe vehicles 10 have performed at the sudden-deceleration-prone spot. For example, if many of the probe vehicles 10 have performed steering operations to the right, the driver can make a lane change to the right lane in advance, thereby avoiding an obstacle present at the sudden-deceleration-prone spot. When the target vehicle 30 approaches the sudden-deceleration-prone spot (e.g., when the target vehicle 30 reaches a position 300 m upstream of the sudden-deceleration-prone spot), the navigation unit 34 may notify the driver of the steering information or information indicating that the driver is approaching the sudden-deceleration-prone spot, by voice.

The traveling control unit 38 controls an engine, a brake, steering, a direction indicator, and the like, thereby causing the target vehicle 30 to travel automatically. Based on the sudden-deceleration-prone spot information and the steering information, the traveling control unit 38 executes a speed control and a steering control to avoid an obstacle when the target vehicle 30 approaches the sudden-deceleration-prone spot. For example, if many of the probe vehicles 10 have performed steering operations to the right at the sudden-deceleration-prone spot, the traveling control unit 38 can avoid an obstacle present at the sudden-deceleration-prone spot by making a lane change to the right lane in advance.

[1-5. Processing Flow of Server 20]

Figure 5:
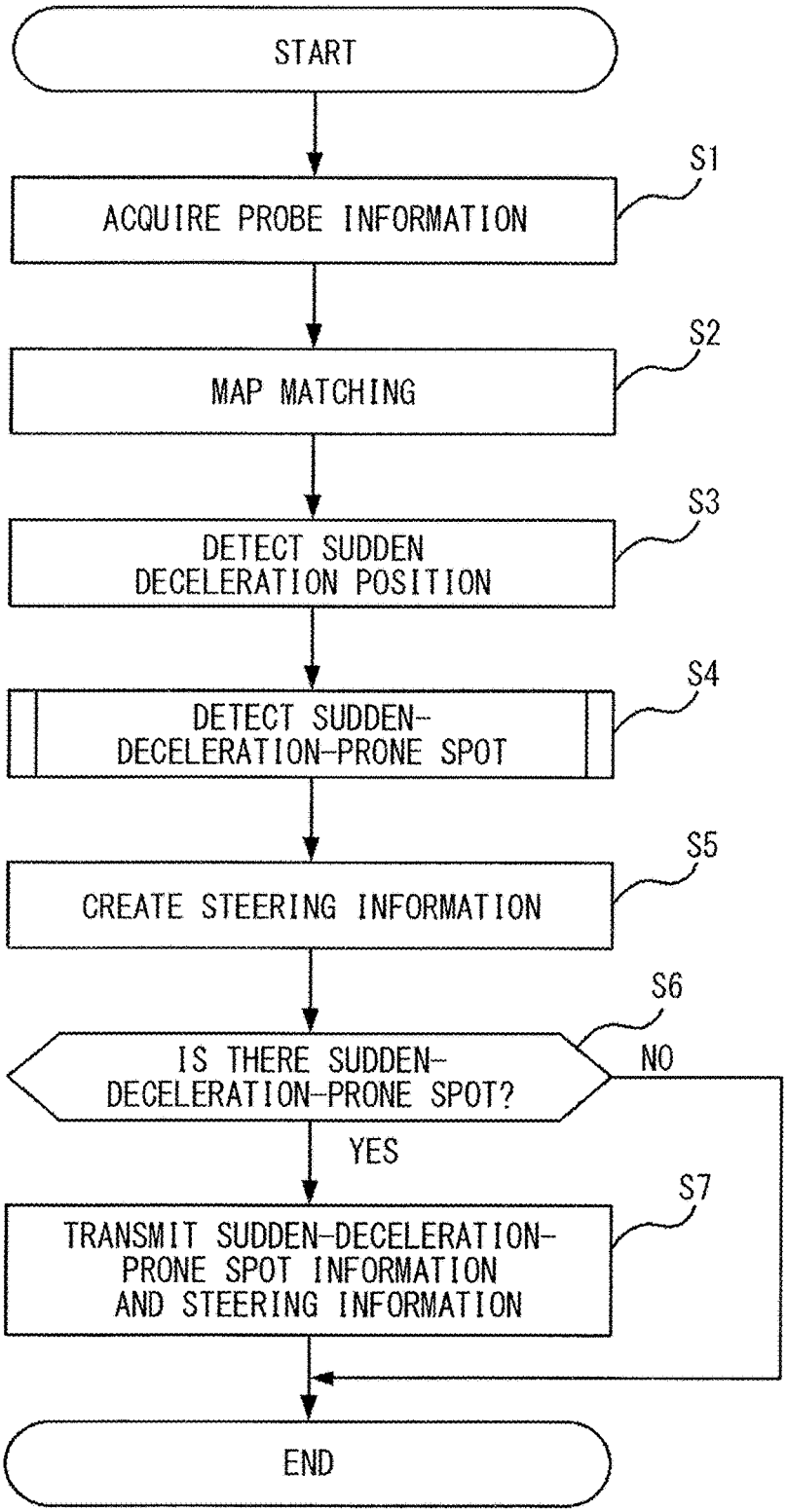
FIG. 5 is a flowchart showing a flow of processing executed by the server, according to the first embodiment.
Figure 6:
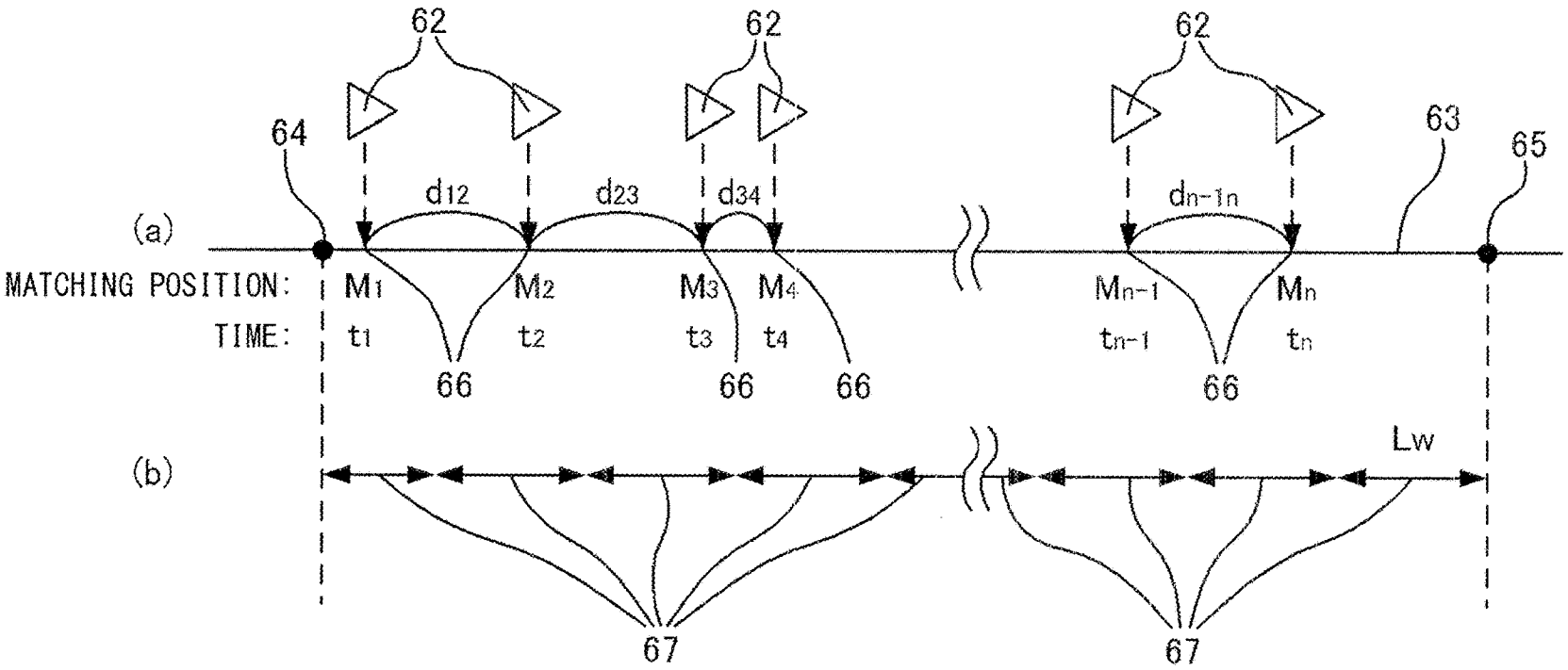
FIG. 6 is a diagram for explaining the processing executed by the server.

Hereinafter, processing executed by the server 20 will be described in detail. FIG. 5 is a flowchart showing a flow of the processing executed by the server 20 according to the first embodiment. FIG. 6 is a diagram for explaining the processing executed by the server 20.

With reference to FIG. 5, the acquisition unit 22 acquires probe information from each probe vehicle 10 via the communication I/F unit 21 (S1). The acquisition unit 22 writes the acquired probe information into the probe information accumulation unit 23.

The detection unit 25 performs a map matching process on the probe information of the probe vehicle 10 to estimate correct positions of the probe vehicle 10 on a freeway, and corrects the probe information accumulated in the probe information accumulation unit 23 (S2). For example, as shown in (a) of FIG. 6, probe positions 62 indicated by positional information included in the probe information may deviate from a link 63 showing a road. Therefore, the detection unit 25 performs the map matching process including: specifying positions on the link 63 (hereinafter referred to as "matching position"), which are closest to the probe positions 62, based on the map information accumulated in the map information accumulation unit 24; and shifting the probe positions 62 to matching positions 66. Thus, the probe information accumulated in the probe information accumulation unit 23 is corrected. Through this process, the positions indicated by the probe information accumulated in the probe information accumulation unit 23 indicate the positions on the road.

Based on the probe information after the map matching process, accumulated in the probe information accumulation unit 23, the detection unit 25 detects a position at which the probe vehicle 10 is suddenly decelerated (hereinafter referred to as "sudden deceleration position") (S3). As shown in (a) of FIG. 6, temporally continuing n matching positions 66 (n: a prescribed integer not smaller than 3) are matching positions M1, M2, . . . , Mn in chronological order.

In addition, times, indicated by the probe information, corresponding to the matching positions M1, M2, . . . , Mn are t1, t2, . . . , tn, respectively. Further, a direct distance between a matching position Mi and a matching position Mi+1 is dii+1 (i=1 to n−1). The detection unit 25 determines that the matching position M1 is a sudden deceleration position when either of the following conditions 1 or 2 is satisfied with respect to the matching positions M1, M2, . . . , Mn.

(Condition 1):

(a) an acceleration α2, of the probe vehicle 10 at the matching position M2, which is calculated based on a speed v1 of the probe vehicle 10 at the matching position M1 and a speed v2 of the probe vehicle 10 at the matching position M2, is not greater than an acceleration threshold THα (THα: a value not greater than 0); and (b) each of time differences (t2−t1, t3−t2, . . . , tn−tn−1) between two temporally continuing matching positions 66 is not greater than a time threshold THt; and (c) each of direct distances (d12, d23, . . . , dn−1n) between two temporally continuing matching positions 66 is not greater than a distance threshold THd; and (d) at any of the matching positions M2 to Mn, the speed vi (i=2 to n) of the probe vehicle 10 is 0.

(Condition 2):

all the conditions (a) to (c) described above are satisfied; and (e) at any of the matching positions M2 to Mn, the speed vi (i=2 to n) of the probe vehicle 10 is not lower than a speed threshold THv.

The condition 1 is a condition for determining that the probe vehicle 10 is suddenly decelerated between the matching positions M1 and M2, and stopped. That is, when the condition (a) is satisfied, it is determined that the probe vehicle 10 is suddenly decelerated. When the condition (d) is satisfied, it is determined that the probe vehicle 10 is stopped. The conditions (b) and (c) are conditions for determining whether the matching positions are closely sampled in terms of time and distance. The condition 1 is satisfied when the probe vehicle 10 is suddenly stopped to avoid collision with an obstacle, for example.

The condition 2 is a condition for determining that the probe vehicle 10 is suddenly decelerated between the matching positions M1 and M2, and thereafter runs at a high speed. The conditions (a) to (c) are the same as described above. When the condition (e) is satisfied, it is determined that the probe vehicle 10 runs at a high speed. The condition 2 is satisfied when the probe vehicle 10 temporarily performs sudden deceleration and steering operation to avoid an obstacle, and thereafter passes by the side of the obstacle at a high speed.

As for the speed vi of the probe vehicle 10 at the matching position Mi, the speed vi included in the probe information can be used. However, if no speed vi is included in the probe information, the speed vi may be calculated based on the information about the position of the probe vehicle 10 and the time when the probe vehicle 10 passes through the position, which is included in the probe information. For example, the speed vi can be calculated according to the following formulae 1 and 2 (i=1 to n).

$$vi=di-1i/(ti-ti-1) \quad \text{(formula 1)}$$

However, only when i=1, $$v1=v2=d12/(t2-t1) \quad \text{(formula 2)}$$

An acceleration αi (i=1 to n) can be calculated according to the following formulae 3 and 4. That is, an acceleration calculated based on the speeds at two matching positions 66 is regarded as the acceleration at the downstream-side matching position 66.

$$\alpha i=(vi-vi-1)/(ti-ti-1) \quad \text{(formula 3)}$$

However, only when i=1, $$\alpha 1=0 \quad \text{(formula 4)}$$

The acceleration αi (i=1 to n) may be calculated according to the following formulae 5 and 6. That is, an acceleration calculated from the speeds at two matching positions 66 is regarded as the acceleration of the upstream-side matching position 66.

$$\alpha i=(vi+1-vi)/(ti+1-ti) \quad \text{(formula 5)}$$

However, only when i=n, $$\alpha n=0 \quad \text{(formula 6)}$$

When the acceleration αi is calculated according to the formulae 5 and 6, the following condition (a') is used instead of the aforementioned condition (a). That is, the acceleration at the upstream-side matching position 66 calculated from the speeds of the two matching positions 66 is compared with the acceleration threshold THα.

(a') An acceleration α1 of the probe vehicle 10 at the matching position M1, which is calculated based on the speed v1 of the probe vehicle 10 at the matching position M1 and the speed v2 of the probe vehicle 10 at the matching position M2, is not greater than the acceleration threshold THα (THα: a value not greater than 0).

The detection unit 25 sequentially detects sudden deceleration positions while shifting the matching positions one by one toward the downstream direction. For example, the detection unit 25 detects a sudden deceleration position in the same manner as above, with the matching positions M2 to Mn+1 being the next matching positions M1 to Mn. If sudden deceleration positions are detected at a plurality of continuing matching positions 66, the temporally oldest sudden deceleration position is regarded as the sudden deceleration position detected by the detection unit 25. Thus, from the probe information of one probe vehicle 10, one sudden deceleration position can be detected for one obstacle, which prevents the sudden deceleration position from being detected repeatedly.

The detection unit 25 totalizes the detected sudden deceleration positions to detect a sudden-deceleration-prone spot (S4). Hereinafter, a sudden-deceleration-prone spot detecting process will be described in detail.

Figure 7:
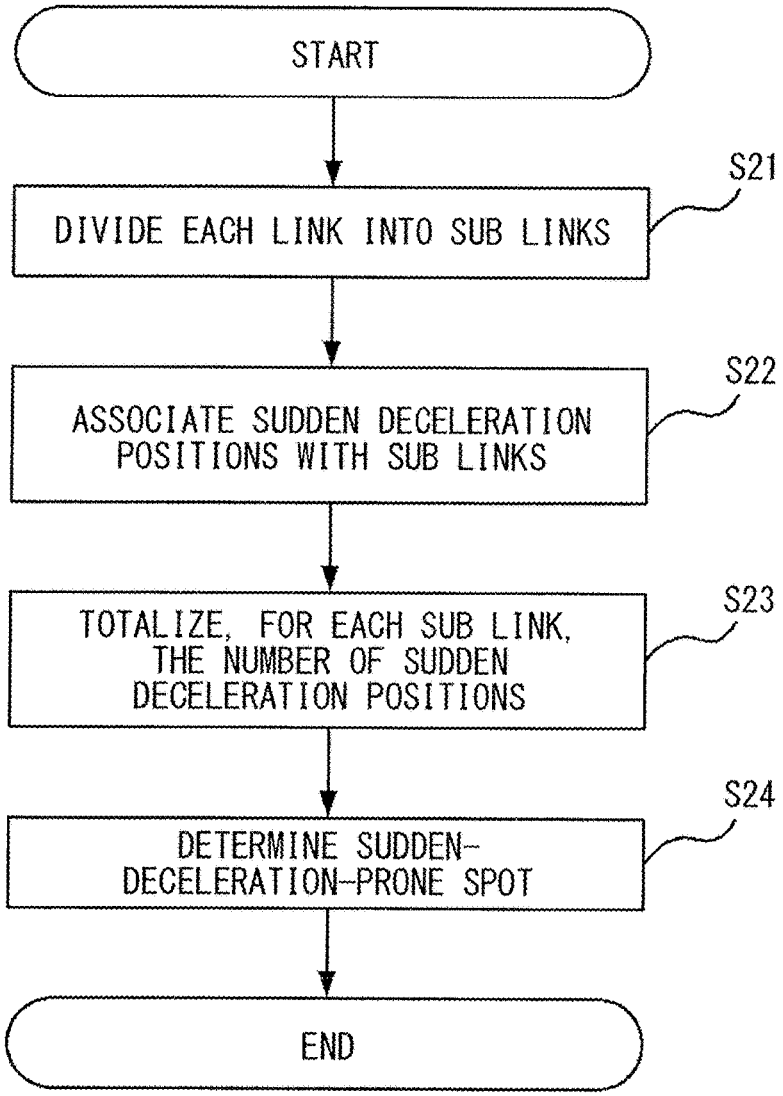
FIG. 7 is a specific flowchart of a sudden-deceleration-prone spot detecting process (S4 in FIG. 5).

FIG. 7 is a flowchart showing the sudden-deceleration-prone spot detecting process (S4 in FIG. 5) in detail.

With reference to FIG. 7, the detection unit 25 divides each link at regular intervals from an upstream endpoint of the link into a plurality of links (S21). The divided links are referred to as sub links hereinafter. For example, the detection unit 25 divides the link 63 shown in (a) of FIG. 6 at regular intervals Lw (e.g., 50 m) from a link endpoint 65 into a plurality of sub links 67 as shown in (b) of FIG. 6.

The detection unit 25 associates the sudden deceleration positions with the sub links 67 (S22). For example, the detection unit 25 performs the association by checking to which sub link 67 each sudden deceleration position belongs, based on a road distance from the downstream endpoint 65 of the link 63 to the sudden deceleration position.

The detection unit 25 totalizes, for each sub link 67, the number of sudden deceleration positions in each totalization unit time indicated by methods A to E described later (S23).

That is, the detection unit 25 totalizes the number of occurrences of sudden deceleration in each sub link 67 within the totalization unit time.

The detection unit 25 determines, for each sub link 67, whether or not the sub link 67 corresponds to a sudden-deceleration-prone spot, thereby detecting a sudden-deceleration-prone spot (S24). That is, the detection unit 25 determines, for each sub link 67, whether or not the sub link 67 corresponds to a sudden-deceleration-prone spot, according to at least one of the following methods A to E, thereby detecting a sudden-deceleration-prone spot.

(Method A): A sub link, in which the total number of sudden deceleration positions within a time period from the present back to a predetermined time point Lt1 in the past is not less than a number-of-sudden-deceleration threshold THc1, is detected as a sudden-deceleration-prone spot.

(Method B): A sub link, in which the total number of sudden deceleration positions within a time period from a certain reference time point in the past back to a predetermined time point Lt2 in the past is not less than a number-of-sudden-deceleration threshold THc2, is detected as a sudden-deceleration-prone spot in the time period.

(Method C): A sub link, in which the total number of sudden deceleration positions obtained the day before is not less than a number-of-sudden-deceleration threshold THc3, is detected as a sudden-deceleration-prone spot.

(Method D): A certain period in the past and sub periods into which the certain period is divided, are set. A sub link, in which the number of sub periods each having not less than a certain number of detected sudden deceleration is not less than a certain number within the certain period in the past, is detected as a sudden-deceleration-prone spot. For example, it is assumed that the certain period is 90 days, each sub period is 1 day, the certain number of detected sudden deceleration is 1, and the certain number of sub periods is 45. Then, a sub link, in which the number of days each having not less than one sudden deceleration position is not less than 45 days among 90 days in the past, is detected as a sudden-deceleration-prone spot.

(Method E): A sub link, which has been detected by the method B as a sudden-deceleration-prone spot by not less than a certain number of times within a certain period in the past, is detected as a sudden-deceleration-prone spot in the time period described in the method B. For example, it is assumed that the certain period is 90 days, the certain number of times is 10, and the time period is from 12:00 to 12:15. Then, a sub link, which has been detected by the method B as a sudden-deceleration-prone spot by not less than 10 times within the time period from 12:00 to 12:15, is detected as a sudden-deceleration-prone spot within the time period from 12:00 to 12:15.

The method A enables detection of a spot in which sudden deceleration frequently occurs at present. The methods B to E enable detection of a spot in which sudden deceleration frequently occurred in the past, and sudden deceleration is highly likely to frequently occur at present. The sudden-deceleration-prone spot detection methods are not limited to those described above. If the total number of sudden deceleration positions within at least a totalization target period is known, a sudden-deceleration-prone spot can be detected based on the total number of sudden deceleration positions.

Referring back to FIG. 5, the creation unit 26 creates steering information of probe vehicles 10 at the sudden-deceleration-prone spot detected by the detection unit 25, based on the probe information acquired by the acquisition unit 22 and accumulated in the probe information accumulation unit 23. That is, the creation unit 26 extracts steering directions from the probe information obtained when the probe vehicles 10 have performed sudden deceleration at the sudden-deceleration-prone spot within a predetermined time period. Based on the extracted steering directions, the creation unit 26 calculates obstacle avoidance direction occurrence ratios shown in the following formulae 7 to 9, and creates steering information including the calculated occurrence ratios.

leftward avoidance occurrence ratio=number of occurrences of leftward avoidance/number of sudden deceleration positions (formula 7)

rightward avoidance occurrence ratio=number of occurrences of rightward avoidance/number of sudden deceleration positions (formula 8)

frontward avoidance occurrence ratio=1−(leftward avoidance occurrence ratio+rightward avoidance occurrence ratio) (formula 9)

When the steering angle is not smaller than a predetermined angle in the rightward direction, it is determined that rightward avoidance occurs. When the steering angle is not smaller than a predetermined angle in the leftward direction, it is determined that leftward avoidance occurs.

The provision unit 27 determines, for each link 63, whether or not a sudden-deceleration-prone spot has been detected within the link 63 (S6). When a sudden-deceleration-prone spot has been detected within the link 63 (YES in S6), the provision unit 27 transmits the sudden-deceleration-prone spot information and the steering information to the target vehicle 30 via the communication I/F unit 21 (S7).

Upon receiving the sudden-deceleration-prone spot information and the steering information, the target vehicle 30 executes the safety driving assistant process as described above, based on these pieces of information. That is, the navigation unit 34 displays these pieces of information on the display screen 39, and the traveling control unit 38 executes speed control and steering control, based on these pieces of information. For example, if the leftward avoidance occurrence ratio is higher than the rightward avoidance occurrence ratio and the frontward avoidance occurrence ratio at the sudden-deceleration-prone spot, the traveling control unit 38 performs, for example, control to reduce the speed and make a lane change to the left lane in advance. If the frontward avoidance occurrence ratio is higher than the leftward avoidance occurrence ratio and the rightward avoidance occurrence ratio, the traveling control unit 38 performs, for example, control to reduce the speed in advance so that the target vehicle 30 can stop before the sudden-deceleration-prone spot.

Figure 8:
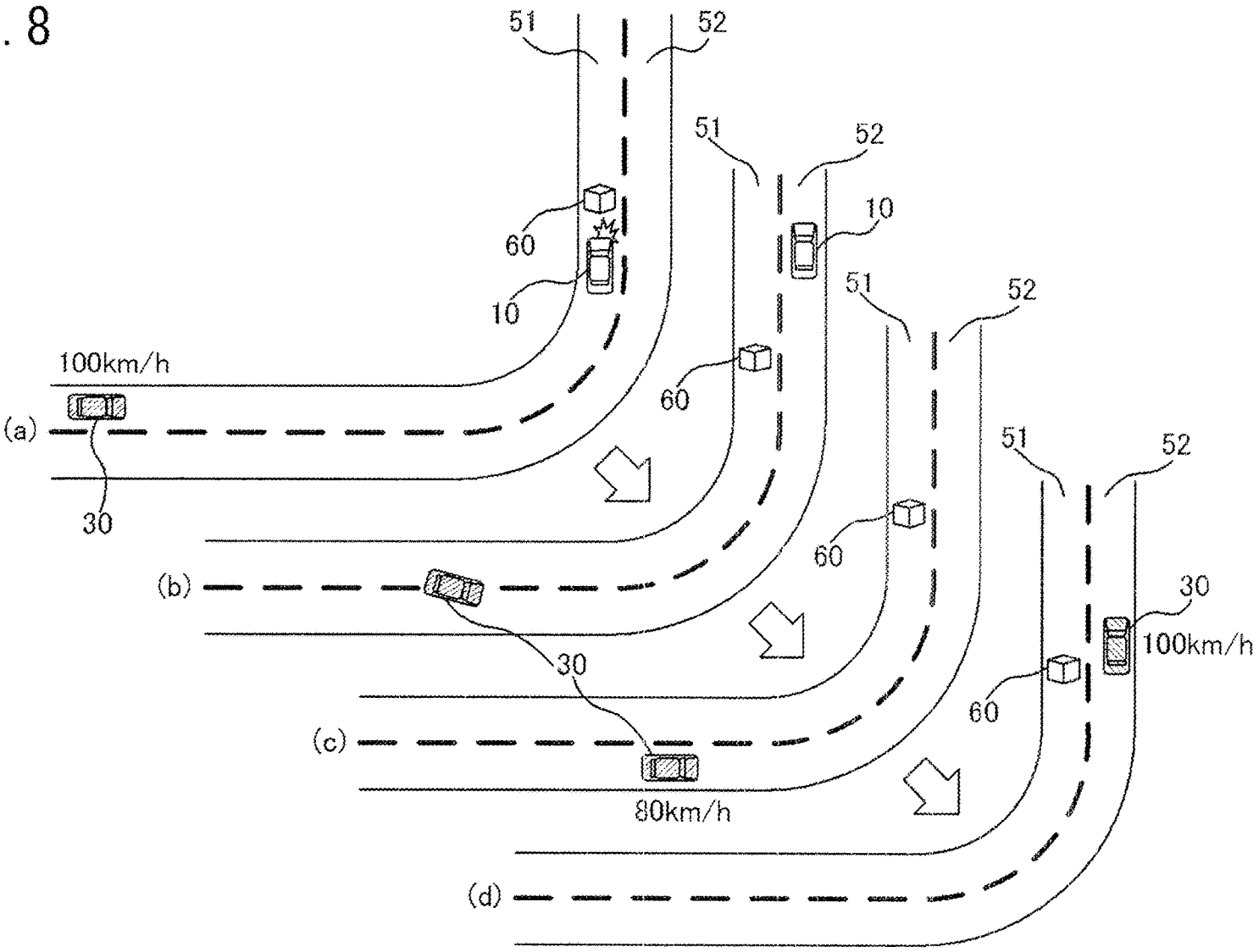
FIG. 8 is a diagram showing an example of obstacle avoidance by a target vehicle.

FIG. 8 shows an example of obstacle avoidance by the target vehicle 30. FIG. 8 shows a curved section of a road with two lanes in each direction. As shown in (a) of FIG. 8, when sudden deceleration of probe vehicles 10 frequently occurs at a position before an obstacle 60 on a first lane 51, this position is detected as a sudden-deceleration-prone spot, and the avoidance direction occurrence ratios at the sudden-deceleration-prone spot are calculated. The sudden-deceleration-prone spot information and the steering information indicating the sudden-deceleration-prone spot and the avoidance direction occurrence ratios, respectively, are transmitted to the target vehicle 30 traveling on the same road at a speed of 100 km/h. If the rightward avoidance occurrence ratio is highest in the steering information, the target vehicle 30 makes a lane change from the first lane 51 to a second lane 52 at a position before the obstacle 60 as shown in (b) of FIG. 8. Further, the target vehicle 30 reduces the speed to 80 km/h so as to be able to take immediate response such as steering operation, as shown in (c) of FIG. 8. After checking the obstacle on the first lane 51, the target vehicle 30 determines that there is no problem in continuing running, and passes by the right side of the obstacle 60 at 100 km/h, as shown in (d) of FIG. 8.

[1-6. Effect and the Like of First Embodiment]

As described above, according to the first embodiment of the present disclosure, a sudden-deceleration-prone spot is detected based on probe information acquired from probe vehicles 10, and sudden-deceleration-prone spot information is provided to the target vehicle 30. Since each probe vehicle 10 can travel in an arbitrary position on a road, the server 20 can acquire probe information of the probe vehicle 10 at an arbitrary position. Therefore, the server 20 can detect a sudden-deceleration-prone spot at an arbitrary position on the road. Further, there is no limitation on the place where the sudden-deceleration-prone spot information is provided. Accordingly, the server 20 can provide, in advance, the target vehicle 30 with information about a spot where sudden deceleration frequently occurs among arbitrary spots on the road.

The server 20 can provide the target vehicle 30 with information of steering directions accompanying steering operations performed by probe vehicles 10 at the sudden-deceleration-prone spot. Therefore, based on the information, the target vehicle 30 can perform a steering operation to avoid an obstacle.

The server 20 detects a sudden-deceleration-prone spot after performing the map matching process for associating the probe positions 62 with the matching positions 66 on the link 63, as shown in FIG. 6. Therefore, even when the probe positions 62 deviate from the road, the sudden-deceleration-prone spot on the road can be accurately detected.

The target vehicle 30 can receive, at an arbitrary position, sudden-deceleration-prone spot information generated at an arbitrary position on the road. Therefore, the target vehicle 30 can acquire the sudden-deceleration-prone spot information before arriving at the sudden-deceleration-prone spot, thereby assisting safe driving of the target vehicle 30.

Second Embodiment

In the first embodiment, detection of a sudden-deceleration-prone spot is performed using a plurality of pieces of probe information without discriminating them. This second embodiment is different from the first embodiment in that detection of a sudden-deceleration-prone spot is performed by preferentially using probe information acquired from probe vehicles 10 that are automatic traveling vehicles. Hereinafter, this difference from the first embodiment will be mainly described while detailed description for the configuration similar to the first embodiment is not repeated.

The configuration of a safety driving assistant system according to the second embodiment is the same as that of the safety driving assistant system 1 according to the first embodiment shown in FIG. 1.

Further, the configurations of the probe vehicle 10, the server 20, and the target vehicle 30 of the second embodiment are the same as the probe vehicle 10, the server 20 and the target vehicle 30 according to the first embodiment shown in FIG. 2, FIG. 3, and FIG. 4, respectively.

The probe vehicles 10 include two types of vehicles, i.e., automatic traveling vehicles and general traveling vehicles that are driven by drivers. Each automatic traveling vehicle travels based on map information having highly-accurate positional information. Therefore, probe information acquired from the automatic traveling vehicle includes information of lanes on which the vehicle has traveled. Meanwhile, generally, probe information acquired from each general traveling vehicle does not include such lane information.

[2-1. Processing Flow of Server 20]

Figure 9:
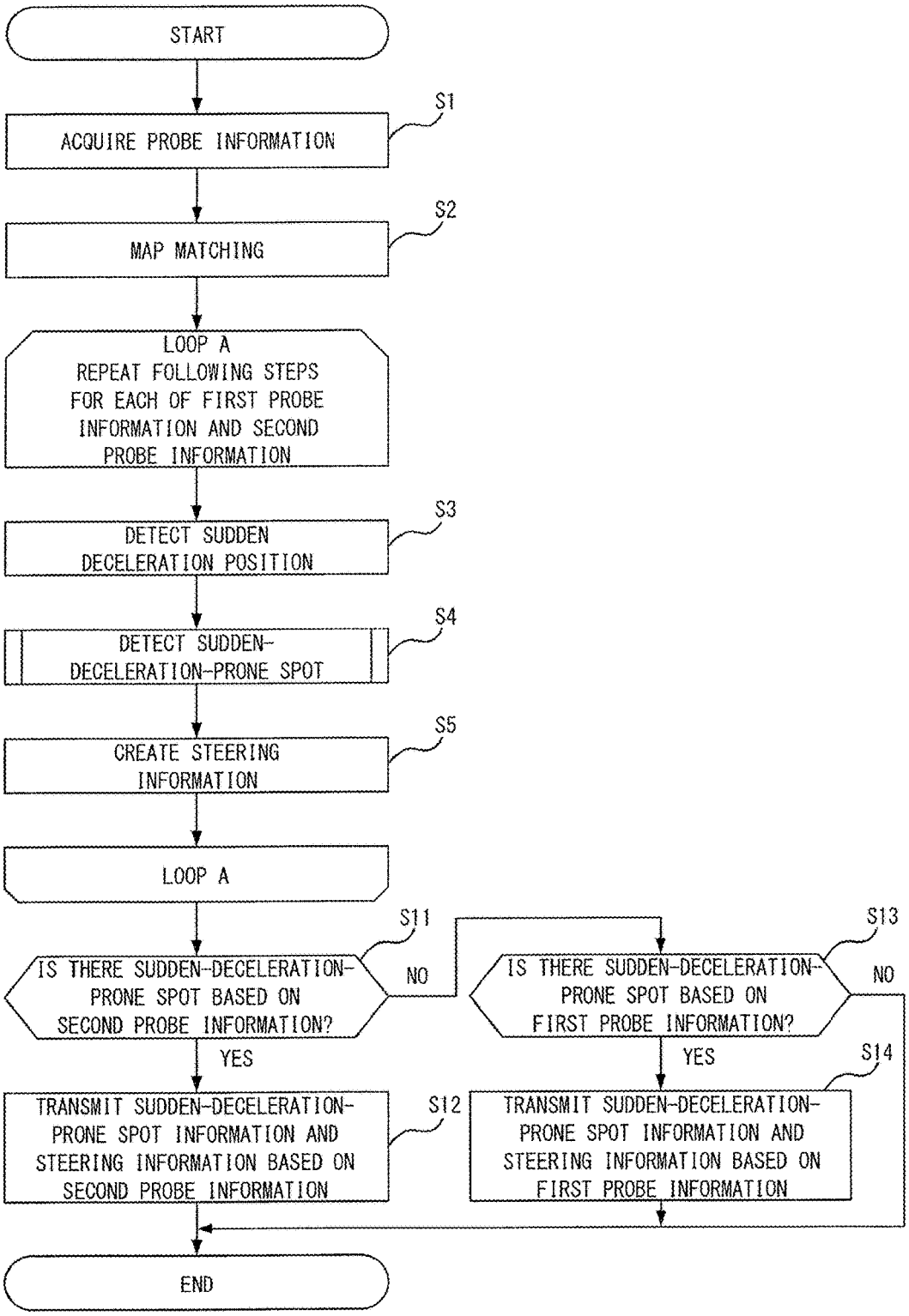
FIG. 9 is a flowchart showing a flow of processing executed by the server, according to a second embodiment.

FIG. 9 is a flowchart showing a flow of processing executed by the server 20 according to the second embodiment. With reference to FIG. 9, a probe information acquisition process (S1) and a link matching process (S2) are the same as those described with reference to FIG. 5.

Here, probe information acquired by the acquisition unit 22 is regarded as first probe information. That is, combination of probe information acquired from automatic traveling vehicles and probe information acquired from general traveling vehicles is regarded as the first probe information. In addition, in the first probe information, the probe information acquired from the automatic traveling vehicles is regarded as second probe information.

The server 20 executes the sudden deceleration position detecting process (S3), the sudden-deceleration-prone spot detecting process (S4), and the steering information creating process (S5) for each of the first probe information and the second probe information. The processes in steps S3 to S5 are the same as those described with reference to FIG. 5. Through this, sudden-deceleration-prone spot information and steering information based on the first probe information are created, and sudden-deceleration-prone spot information and steering information based on the second probe information are created. The second probe information includes lane information. Therefore, the processes in steps S3 to S5 based on the second probe information are performed for each lane. The sudden-deceleration-prone spot information created based on the second probe information also includes the lane information. That is, the sudden-deceleration-prone spot information based on the second probe information allows knowing about on which lane and where on the lane sudden deceleration frequently occurs.

The provision unit 27 determines, for each link 63, whether or not a sudden-deceleration-prone spot has been detected within the link 63, based on the second probe information (S11). If a sudden-deceleration-prone spot based on the second probe information has been detected within the link 63 (YES in S6), the provision unit 27 transmits sudden-deceleration-prone spot information and steering information based on the second probe information to the target vehicle 30 via the communication I/F unit 21 (S12).

If a sudden-deceleration-prone spot based on the second probe information has not been detected within the link 63 (NO in S6), the provision unit 27 determines whether or not a sudden-deceleration-prone spot based on the first probe information has been detected within the link 63 (S13). If sudden-deceleration-prone spot based on the first probe information has been detected within the link 63 (YES in S13), the provision unit 27 transmits sudden-deceleration-prone spot information and steering information based on the first probe information to the target vehicle 30 via the communication I/F unit 21 (S14).

Through the aforementioned processes, in each link, the sudden-deceleration-prone spot based on the second probe information can be detected in preference to the sudden-deceleration-prone spot based on the first probe information. The processes in steps S11 to S14 may be performed in units of sub links 67 instead of the link 63.

Upon receiving the sudden-deceleration-prone spot information and steering information based on the second probe information, the target vehicle 30 executes a safety driving assistant process in accordance with these pieces of information. That is, the navigation unit 34 displays these pieces of information on the navigation unit 34. At this time, information of a lane on which sudden deceleration frequently occurs is also displayed. If there is a sudden-deceleration-prone spot on the lane where the target vehicle 30 is traveling, the traveling control unit 38 performs, in advance, the safety driving assistant process such as deceleration or lane change.

Figure 10:
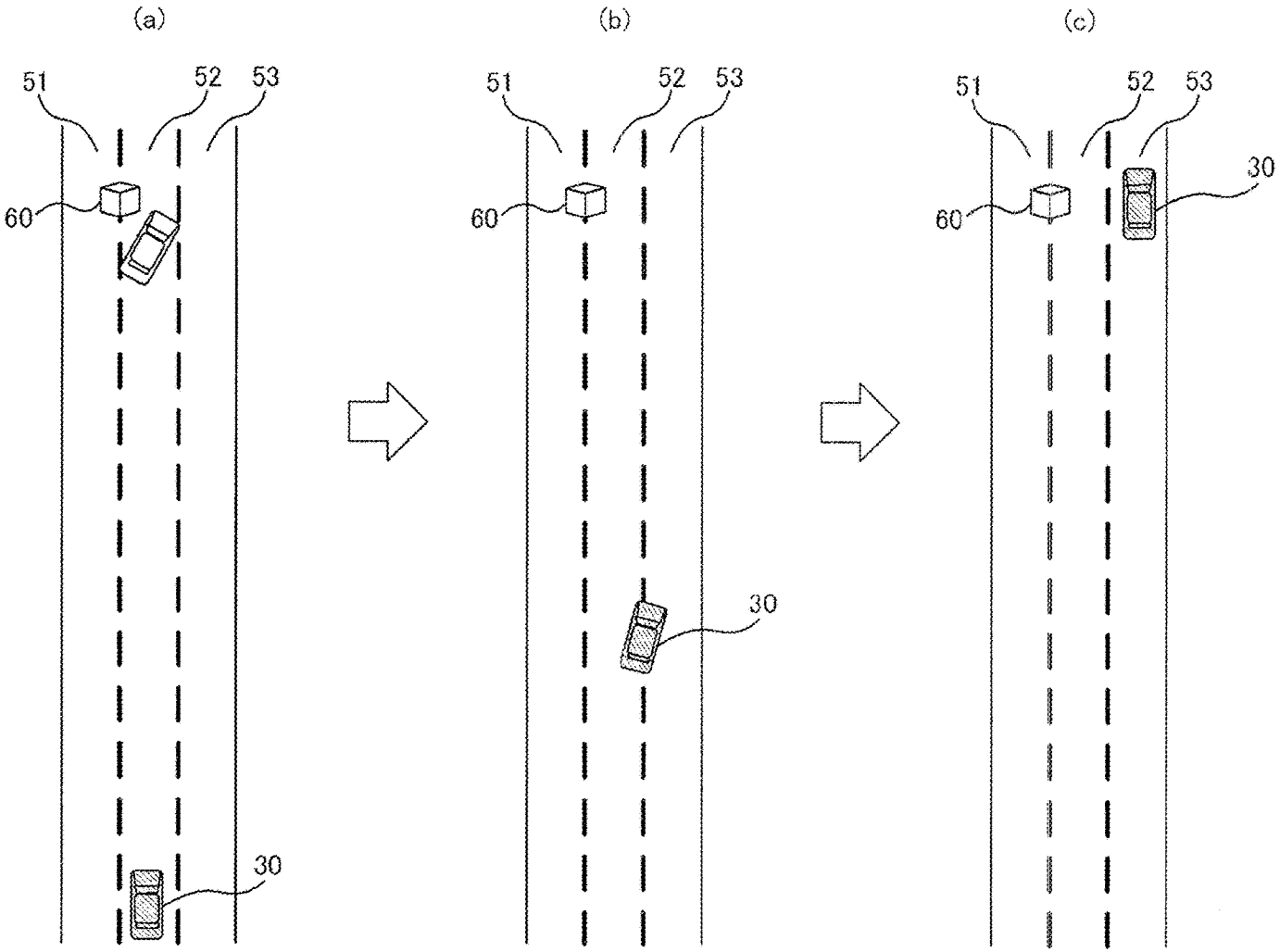
FIG. 10 is a diagram showing another example of obstacle avoidance by the target vehicle.

FIG. 10 shows another example of obstacle avoidance by the target vehicle 30. FIG. 10 shows a road with three lanes in each direction. As shown in (a) of FIG. 10, when an obstacle 60 is present between a first lane 51 and a second lane 52 and sudden deceleration of probe vehicles 10 frequently occurs at a position before the obstacle 60, the position between the first lane 51 and the second lane 52 is detected as a sudden-deceleration-prone spot. In addition, it is assumed that the rightward avoidance occurrence ratio is highest at the sudden-deceleration-prone spot. These pieces of information are transmitted as the sudden-deceleration-prone spot information and the steering information to the target vehicle 30 traveling on the second lane 52. Based on the two pieces of information, the target vehicle 30 makes, in advance, a lane change from the second lane 52 to a third lane 53 at a position before the obstacle 60 in order to avoid the sudden-deceleration-prone spot, as shown in (b) of FIG. 10. Since it is known that no sudden-deceleration-prone spot is present on the third lane 53, the target vehicle 30 passes by the right side of the obstacle 60 while checking the obstacle 60 without reducing the speed, as shown in (c) of FIG. 10.

[2-2. Effects and the Like of Second Embodiment]

As described above, according to the second embodiment of the present disclosure, a sudden-deceleration-prone spot can be detected for each lane by using the second probe information. Therefore, it is possible to detect on which lane sudden deceleration frequently occurs. Thus, the target vehicle 30, which is coming from the upstream side of the lane and the spot where sudden deceleration frequently occurs, can take an action to avoid an obstacle by making a lane change from the lane, for example.

An automatic traveling vehicle includes various sensors such as a camera and a radar for observing the surrounding situations, and is designed to perform safe driving at all times, and therefore does not perform unnecessary sudden deceleration. Therefore, when even such an automatic traveling vehicle has to perform sudden deceleration, it is considered that an obstacle is highly likely to be present. Therefore, by detecting a sudden-deceleration-prone spot based on the second probe information acquired from the automatic traveling vehicle, reliability of the sudden-deceleration-prone spot can be increased, resulting in safer driving support of the target vehicle.

Further, the sudden-deceleration-prone spot detected based on the second probe information is adopted as a detection result in preference to the sudden-deceleration-prone spot detected based on the first probe information. Therefore, the highly-reliable sudden-deceleration-prone spot can be preferentially detected.

Third Embodiment

In the second embodiment, detection of a sudden-deceleration-prone spot is performed by preferentially using probe information acquired from probe vehicles 10 that are automatic traveling vehicles. However, probe information to be preferentially used is not limited to probe information acquired from automatic traveling vehicles. That is, any probe information may be preferentially used as along as the probe information is acquired from probe vehicles 10 whose traveling lanes can be identified. Hereinafter, a vehicle whose traveling lane can be identified is referred to as a lane identifiable vehicle. An automatic traveling vehicle is a type of lane identifiable vehicle.

In this third embodiment, the lane identifiable vehicle will be described in detail.

[3-1. Configuration of Probe Vehicle 10 as Lane Identifiable Vehicle]

Figure 11:
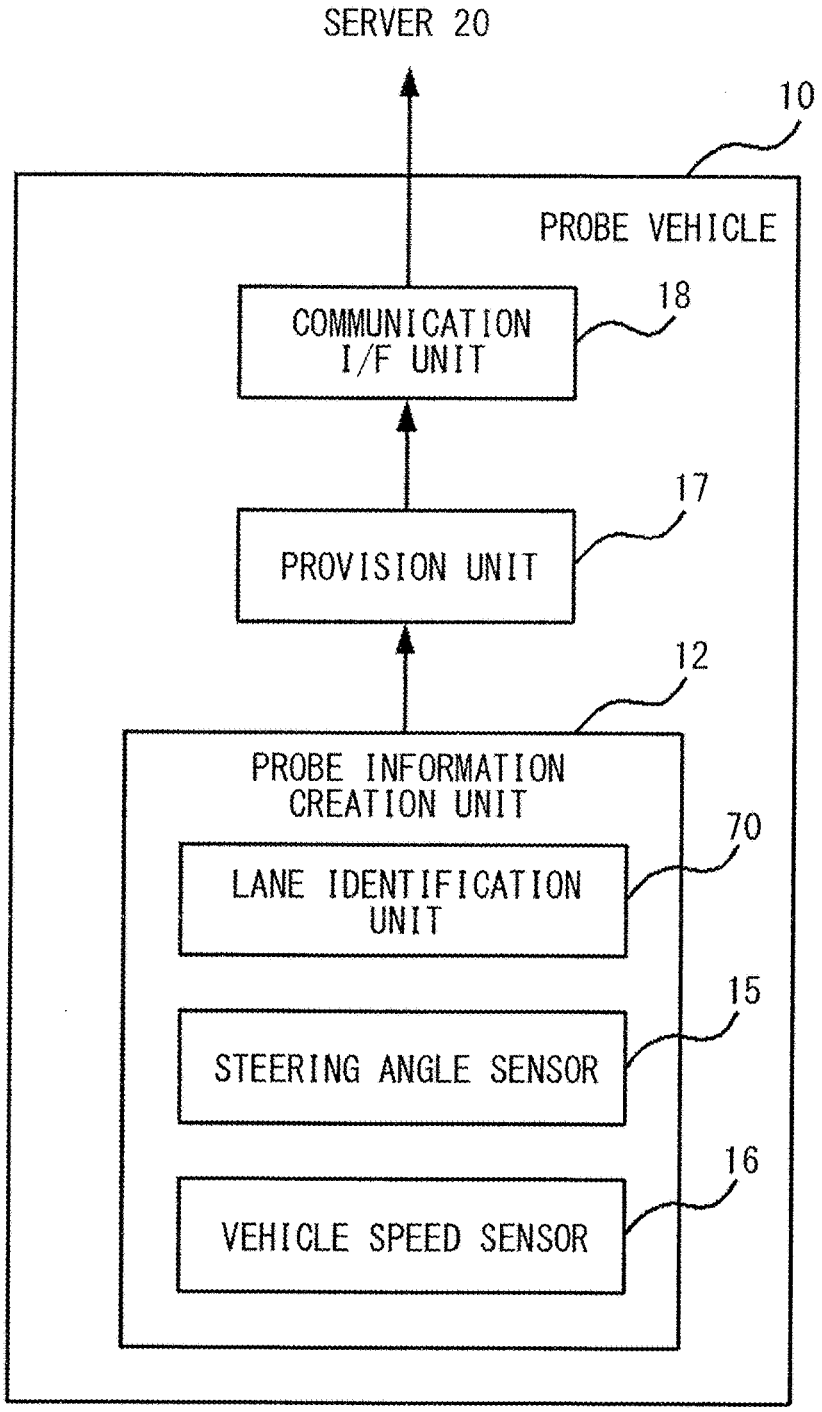
FIG. 11 is a block diagram showing a functional configuration of a probe vehicle that is a lane identifiable vehicle.

FIG. 11 is a block diagram showing a functional configuration of a probe vehicle 10 that is a lane identifiable vehicle. With reference to FIG. 11, the probe vehicle 10 includes a lane identification unit 70 instead of the GPS device 14 in the configuration of the probe vehicle 10 shown in FIG. 2.

Figure 12:
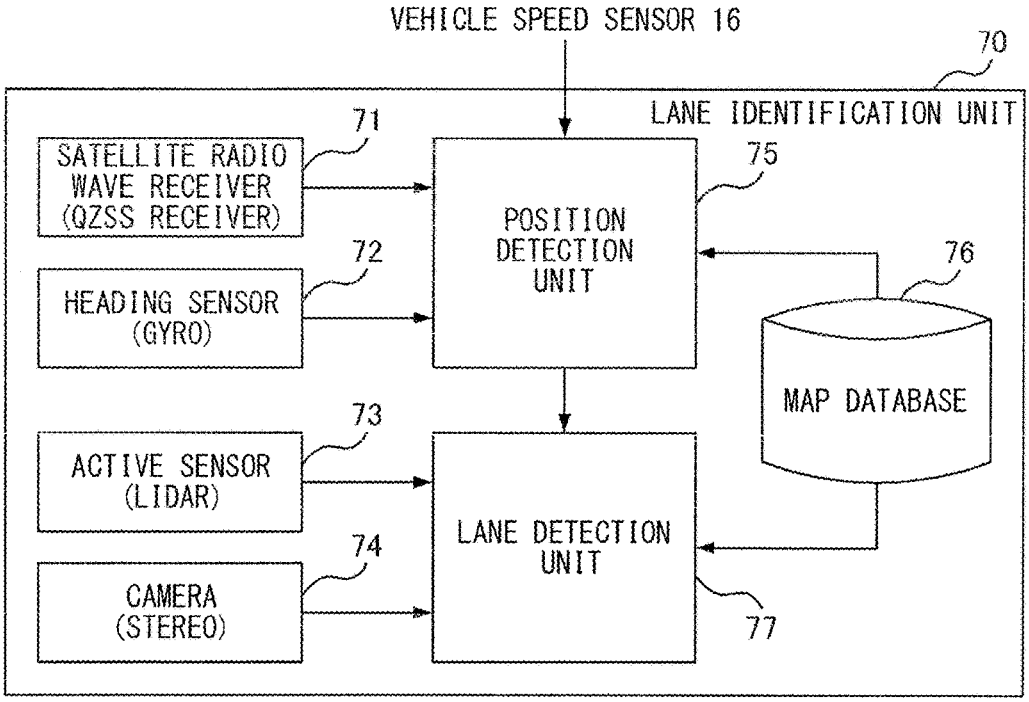
FIG. 12 is a block diagram showing a functional configuration of a lane identification unit.

FIG. 12 is a block diagram showing a functional configuration of the lane identification unit 70. With reference to FIG. 12, the lane identification unit 70 is a processing unit for identifying a link and a lane on which the probe vehicle 10 travels. The lane identification unit 70 includes a satellite radio wave receiver 71, a heading sensor 72, an active sensor 73, a camera 74, a position detection unit 75, a map database 76, and a lane detection unit 77. The position detection unit 75 and the lane detection unit 77 are implemented by a processor such as a CPU or an MPU that performs digital signal processing. These units 75 and 77 may be implemented by a single processor, or may be implemented by separate processors.

The satellite radio wave receiver 71 receives radio waves from a satellite, and measures the latitude, longitude, and altitude of the position where the probe vehicle 10 is located. Although a GPS receiver is commonly used as the satellite radio wave receiver 71, it is desirable to use a QZSS (Quasi-Zenith Satellite System) receiver having higher accuracy than the GPS receiver. By using the QZSS receiver, a positioning signal received by a GPS receiver is complemented and reinforced to improve positioning accuracy.

The heading sensor 72 is a sensor for measuring heading of the probe vehicle 10, and is implemented by an oscillating-type gyroscope or optical gyroscope. It is desirable to use, as the heading sensor 72, an optical gyroscope having higher accuracy than the oscillating-type gyroscope.

The active sensor 73 is a sensor for detecting white lines and structures. A sensor using a millimeter wave radar or the like is known as the active sensor 73. However, it is desirable to use LIDAR (Light Detection And Ranging, Laser Imaging Detection And Ranging) which is able to include a difference in reflectivity between a white line and a road surface, in data showing a three-dimensional space structure. According to LIDAR, the distance to a target and the characteristics of the target can be analyzed by measuring scattering light from the target caused by irradiation with laser light emitted in a pulse shape.

The camera 74 detects a white line and a structure from a captured image. The camera 74 may be either a monocular camera or a stereo camera, but it is desirable to use the stereo camera which is able to three-dimensionally determine whether or not a white line is present on the road surface.

The map database 76 is implemented by an HDD or the like in which highly-accurate road map data is stored. The road map data includes information such as road edge (division) lines, road (lane) center lines, road widths, vertical and cross slopes, traffic signal/sign points, stop lines, etc., and has a read-ahead network structure.

The position detection unit 75 collates the positional information of the probe vehicle 10 measured by the satellite radio wave receiver 71 with the road map data stored in the map database 76, thereby detecting the position, on the link, where the probe vehicle 10 is traveling. For example, the position detection unit 75 obtains a traveling locus of the probe vehicle 10 from the positional information of the probe vehicle 10 sequentially outputted from the satellite radio wave receiver 71. The position detection unit 75 compares the obtained traveling locus with the road map data stored in the map database 76, and performs a map matching process of correcting the present position of the probe vehicle 10 on the road, focusing on feature parts on the traveling locus, such as intersections and inflection points, thereby detecting the position of the probe vehicle 10 (refer to Patent Literature 3, for example). If the satellite radio wave receiver 71 cannot measure the positional information of the probe vehicle 10 due to the radio wave status or the like, the position detection unit 75 may calculate the traveling distance of the probe vehicle 10 from the speed of the probe vehicle 10 obtained from the vehicle speed sensor 16, and may sequentially calculate the position of the probe vehicle 10, based on the calculated traveling distance and heading information of the probe vehicle 10 measured by the heading sensor 72.

The lane detection unit 77 collates the white line and the structure detected by the active sensor 73 and the white line and the structure detected by the camera 74 with the road map data stored in the map database 76, thereby identifying the positions of the white line and the structure on the map. The lane detection unit 77 collates the position on the link where the probe vehicle 10 is traveling, which has been detected by the position detection unit 75, with the positions of the white line and the structure on the map, thereby detecting a lane, on the link, where the probe vehicle 10 is traveling. The lane detection unit 77 may selectively use the detection result of the active sensor 73 and the detection result of the camera 74 according to the situation. For example, the lane detection unit 77 may use, in a normal situation, the detection result of the camera 74 to identify the positions of the white line and the structure, whereas the lane detection unit 77 may use, in a situation such as nighttime or bad weather where the driver's visibility around the vehicle is degraded, the detection result of the active sensor 73 which is less affected by the degraded visibility, to identify the positions of the white line and the structure (refer to Patent Literatures 4 and 5, for example).

The lane detection unit 77 may collates positional information of fixed objects (e.g., an illuminating lamp installed at the road shoulder, a cat's eye on the road surface, etc.) detected by the probe vehicle 10 with positional information of fixed objects indicated by the road map data, thereby correcting the position of the probe vehicle 10 (refer to Patent Literature 3, for example).

The information of the position on the link and the line where the probe vehicle 10 is traveling, which are detected by the position detection unit 75 and the lane detection unit 77, respectively, are included in the probe information generated by the probe information generation unit 12 and transmitted to the server 20.

[3-2. Configuration of Target Vehicle 30 as Lane Identifiable Vehicle]

Figure 13:
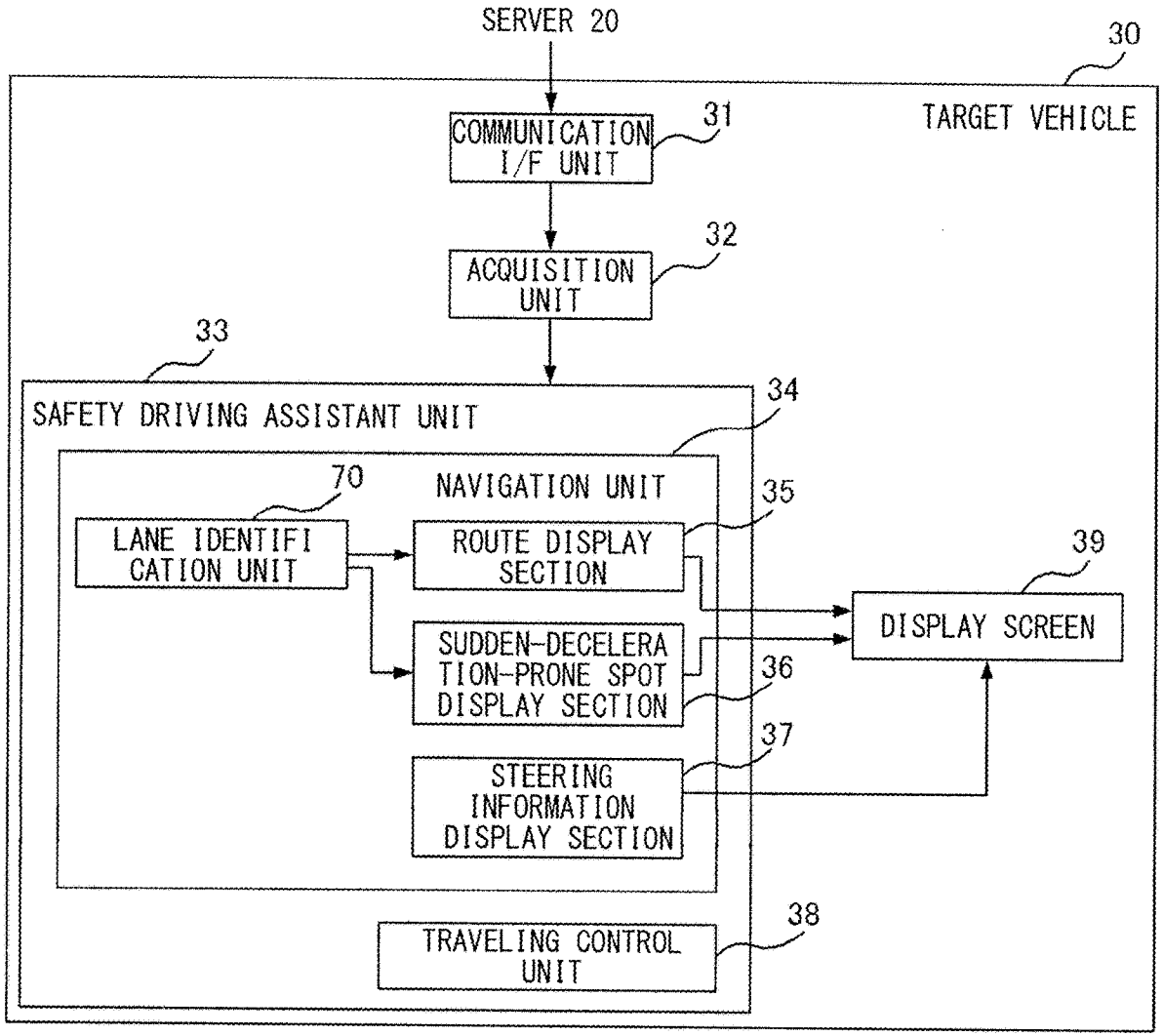
FIG. 13 is a diagram showing a functional configuration of a target vehicle including the lane identification unit.

The configuration of the lane identification unit 70 described above may be included in the target vehicle 30. FIG. 13 is a diagram showing a functional configuration of the target vehicle 30 including the lane identification unit 70. The target vehicle 30 shown in FIG. 13 is identical to the target vehicle 30 shown in FIG. 4 except that the navigation unit 34 further includes the lane identification unit 70.

The route display section 35 calculates a route to a destination while discriminating the lanes from each other, based on the traveling position and the traveling lane of the target vehicle 30 which are identified by the lane identification unit 70, and performs control to display the calculated route on the display screen 39. For example, in order to cause the target vehicle 30, which is traveling on a passing lane of a freeway and intends to exit from the freeway via a left exit, to safely exit from the freeway via the left exit, the route display section 35 calculates a route in which the target vehicle 30 makes a lane change to the leftmost lane in advance. Then, the route display section 35 displays information of the calculated route on the display screen 39.

The sudden-deceleration-prone spot display section 36 performs control to display the sudden-deceleration-prone spot in a visible manner, while discriminating the lanes from each other, based on the traveling position and the traveling lane of the target vehicle 30 which are identified by the lane identification unit 70. For example, when a sudden-deceleration-prone spot is present on the traveling lane of the target vehicle 30, the sudden-deceleration-prone spot display section 36 may perform control to display the sudden-deceleration-prone spot more emphatically than in the case where a sudden-deceleration-prone spot is present on a lane other than the traveling lane. Thus, when a sudden-deceleration-prone spot is present on the traveling lane, the driver can perform control for safer driving by taking an action such as a lane change in advance.

[4. Additional Notes]

While the safety driving assistant systems 1 according to the embodiments of the present disclosure have been described above, the present disclosure is not limited to the embodiments.

Modifications

In the second embodiment, the sudden-deceleration-prone spot is detected by preferentially using the probe information acquired from automatic traveling vehicles. However, the method of preferentially using the probe information acquired from automatic traveling vehicles is not limited to that described in the second embodiment.

For example, when the detection unit 25 of the server 20 detects the sudden-deceleration-prone spot according to any of the aforementioned methods A to E, weighting on totalization of sudden deceleration positions may be differentiated between the automatic traveling vehicle and the general traveling vehicle. For example, the sudden deceleration position detected based on the probe information acquired from the automatic traveling vehicle may be weighted twice (counted twice) the sudden deceleration position detected based on the probe information acquired from the general traveling vehicle, and thereafter, the number of occurrences of sudden deceleration may be totalized.

According to this modification, detection of a sudden-deceleration-prone spot can be performed while placing greater weight on the probe information acquired from the automatic traveling vehicle than on the probe information acquired from the general traveling vehicle. The sudden-deceleration-prone spot detected based on the probe information acquired from the automatic traveling vehicle is highly reliable. On the other hand, when detection of a sudden-deceleration-prone spot is performed based on the probe information acquired from the general traveling vehicle, a wider area can be covered. Therefore, it is possible to detect sudden-deceleration-prone spots in a wide area while detecting highly-reliable sudden-deceleration-prone spots.

In addition to the probe information acquired from the automatic traveling vehicle, the probe information acquired from the lane identifiable vehicle described in the third embodiment may also be weighted more than the probe information acquired from the general traveling vehicle, and then the number of occurrences of sudden deceleration may be totalized.

In the first to third embodiments, the information of the steering direction is included in the probe information, and the steering information is created from the information of the steering direction, and provided to the target vehicle 30. However, the steering information creating process is not an essential process, and the information of the steering direction may not be included in the probe information. When no steering information is provided to the target vehicle 30, the target vehicle 30 or the driver of the target vehicle 30 should determine a steering operation to avoid the obstacle 60.

Although the target vehicle 30 shown in FIG. 4 is assumed to be an automatic traveling vehicle, if the target vehicle 30 is a general traveling vehicle driven by a driver, the traveling control unit 38 need not be provided.

The target vehicle 30 may further include the structure of the probe vehicle 10 shown in FIG. 2. Thus, the target vehicle 30 can transmit probe information from itself.

Each of the aforementioned apparatuses may be specifically configured as a computer system including a microprocessor, an ROM, an RAM, a hard disk drive, a display unit, a keyboard, a mouse, etc. A computer program is stored in the RAM or the hard disk drive. Each apparatus achieves its function through the microprocessor being operated according to the computer program. The computer program is configured by combining a plurality of command codes indicating commands to the computer, in order to achieve predetermined functions.

A part or all of the components of the respective apparatuses may be configured as a single system LSI. The system LSI is a super-multi-function LSI manufactured such that a plurality of components are integrated on a single chip. Specifically, the system LSI is a computer system configured to include a microprocessor, an ROM, an RAM, etc. A computer program is stored in the RAM. The system LSI achieves its function through the microprocessor being operated according to the computer program.

The present disclosure may be the method described above. Further, the present disclosure may be a computer program that causes a computer to execute the method, or may also be a digital signal including the computer program.

The present disclosure may also be realized by storing the computer program or the digital signal in a computer-readable non-transitory recording medium such as a hard disk drive, a CD-ROM, or a semiconductor memory. Alternatively, the present disclosure may also be the digital signal recorded in the non-transitory recording medium.

The present disclosure may also be realized by transmission of the aforementioned computer program or digital signal via a telecommunication line, a wireless or wired communication line, a network represented by the Internet, a data broadcast, etc.

The respective steps included in the program may be executed by a plurality of computers. For example, the detection unit 25, the creation unit 26, and the provision unit 27 included in the server 20 may be realized by executing programs dispersed to a plurality of computers.

The aforementioned embodiments and modifications may be respectively combined.

It is noted that the embodiments disclosed herein are merely illustrative in all aspects and should not be recognized as being restrictive. The scope of the present disclosure is defined by the scope of the claims rather than the meaning described above, and is intended to include meaning equivalent to the scope of the claims and all modifications within the scope.

REFERENCE SIGNS LIST

1 safety driving assistant system
10 probe vehicle
12 probe information generation unit
14 GPS device
15 steering angle sensor
16 vehicle speed sensor
17 provision unit
18 communication I/F unit
20 server
21 communication I/F unit
22 acquisition unit
23 probe information accumulation unit
24 map information accumulation unit
25 detection unit
26 creation unit
27 provision unit
30 target vehicle
31 communication I/F unit
32 acquisition unit
33 safety driving assistant unit
34 navigation unit
35 route display section
36 sudden-deceleration-prone spot display section
37 steering information display section
38 traveling control unit
39 display screen
40 network
42 wireless base station
51 first lane
52 second lane
53 third lane
60 obstacle
62 probe position
63 link
65 link endpoint
66 matching position
67 sub link
70 lane identification unit
71 satellite radio wave receiver
72 heading sensor
73 active sensor
74 camera
75 position detection unit
76 map database
77 lane detection unit

The invention claimed is:

1. A safety driving assistant system, comprising:

an acquisition unit configured to acquire pieces of probe information from probe vehicles, each piece of probe information including information of a position of the corresponding probe vehicle and information of a time at which the probe vehicle has passed through the position;

a detection unit configured to detect a sudden-deceleration-prone spot where sudden deceleration of the probe vehicles frequently occurs, based on the pieces of probe information acquired by the acquisition unit; and a provision unit configured to provide information of the sudden-deceleration-prone spot detected by the detection unit, to a target vehicle that receives safety driving assistance, wherein each piece of probe information further includes information of a lane on which the corresponding probe vehicle travels, and the detection unit detects the sudden-deceleration-prone spot for each lane, based on the pieces of probe information.

2. The safety driving assistant system according to claim 1, wherein the detection unit detects the sudden-deceleration-prone spot, based on probe information acquired from a lane identifiable vehicle capable of identifying a traveling lane thereof, among the pieces of probe information acquired by the acquisition unit.

3. The safety driving assistant system according to claim 2, wherein the detection unit detects, for a target link, sudden-deceleration-prone spots, based on pieces of first probe information that are the pieces of probe information acquired by the acquisition unit and on second probe information that is the probe information acquired from the lane identifiable vehicle among the pieces of first probe information, and the detection unit adopts, as the sudden-deceleration-prone spot on the target link, the sudden-deceleration-prone spot detected based on the second probe information in preference to the sudden-deceleration-prone spot detected based on the first probe information.

4. The safety driving assistant system according to claim 2, wherein the detection unit totalizes, for a target link, the number of occurrences of sudden deceleration of the lane identifiable vehicle, which is based on the probe information acquired from the lane identifiable vehicle among the pieces of probe information acquired by the acquisition unit, after weighting the number of occurrences more than the number of occurrences of sudden deceleration, of the lane identifiable vehicle, which is based on pieces of probe information acquired from vehicles other than the lane identifiable vehicle among the pieces of probe information acquired by the acquisition unit, and the detection unit detects the sudden-deceleration-prone spot on the target link, based on the result of the totalization.

5. The safety driving assistant system according to claim 1, wherein the acquisition unit further acquires information relating to steering of each probe vehicle, the safety driving assistant system further includes a creation unit configured to create information relating to a steering direction of the probe vehicle at the sudden-deceleration-prone spot detected by the detection unit, based on the corresponding probe information acquired by the acquisition unit, and the provision unit further provides, to the target vehicle, information relating to the steering direction of the probe vehicle created by the creation unit.

6. The safety driving assistant system according to claim 1, wherein the detection unit detects the sudden-deceleration-prone spot, based on positions on a link relating to positions of the probe vehicles indicated by the pieces of probe information acquired by the acquisition unit.

7. A vehicle comprising:

an acquisition unit configured to acquire, from a server, information of a sudden-deceleration-prone spot where sudden deceleration of probe vehicles frequently occurs, the sudden-deceleration-prone spot being detected based on pieces of probe information each including information of a position of the corresponding probe vehicle and information of a time at which the probe vehicle has passed through the position; and a safety driving assistant unit configured to execute a safety driving assistant process for the vehicle, based on the information of the sudden-deceleration-prone spot acquired by the acquisition unit, wherein each piece of probe information further includes information of a lane on which the corresponding probe vehicle travels, and the sudden-deceleration-prone spot is detected for each lane, based on the ices of probe information.

8. A non-transitory computer readable storage medium storing a program for causing a computer to function as:

an acquisition unit configured to acquire pieces of probe information from probe vehicles, each piece of probe information including information of a position of the corresponding probe vehicle and information of a time at which the probe vehicle has passed through the position;

a detection unit configured to detect a sudden-deceleration-prone spot where sudden deceleration of probe vehicles frequently occurs, based on the pieces of probe information acquired by the acquisition unit; and a provision unit configured to provide information of the sudden-deceleration-prone spot detected by the detection unit, to a target vehicle that receives safety driving assistance, wherein each piece of robe information further includes information of a lane on which the corresponding probe vehicle travels, and the detection unit detects the sudden-deceleration-prone spot for each lane, based on the pieces of probe information.

9. A non-transitory computer readable storage medium storing a program for causing a computer to function as:

an acquisition unit configured to acquire, from a server, information of a sudden-deceleration-prone spot where sudden deceleration of probe vehicles frequently occurs, the sudden-deceleration-prone spot being detected based on pieces of probe information each including information of a position of the corresponding probe vehicle and information of a time at which the probe vehicle has passed through the position; and a safety driving assistant unit configured to execute a safety driving assistant process for the vehicle, based on the information of the sudden-deceleration-prone spot acquired by the acquisition unit, wherein each piece of probe information further includes information of a lane on which the corresponding probe vehicle travels, and the sudden-deceleration-prone spot is detected for each lane based on the pieces of probe information.

* * * * *